US010753267B2

(12) United States Patent
Dalmas, II et al.

(10) Patent No.: US 10,753,267 B2
(45) Date of Patent: Aug. 25, 2020

(54) METHOD AND APPARATUS FOR PRODUCING STRATIFIED STREAMS

(71) Applicant: Quest Engines, LLC, Coopersburg, PA (US)

(72) Inventors: Elario D. Dalmas, II, Macungie, PA (US); Brett J. Leathers, Allentown, PA (US)

( * ) Notice: Subject to any disclaimer, the term of this patent is extended or adjusted under 35 U.S.C. 154(b) by 26 days.

(21) Appl. No.: 16/257,859

(22) Filed: Jan. 25, 2019

(65) Prior Publication Data

US 2019/0234361 A1 Aug. 1, 2019

Related U.S. Application Data

(60) Provisional application No. 62/622,645, filed on Jan. 26, 2018.

(51) Int. Cl.
*F02B 15/00* (2006.01)
*F02B 23/06* (2006.01)
(Continued)

(52) U.S. Cl.
CPC ..... *F02B 15/00* (2013.01); *F02B 23/0648* (2013.01); *F02B 2023/106* (2013.01); *F02B 2275/48* (2013.01); *F02M 57/00* (2013.01)

(58) Field of Classification Search
CPC ..... F02M 57/00; F02B 23/0648; F02B 2075/125; F02B 2023/106; F02B 2275/48; F02B 15/00
(Continued)

(56) References Cited

U.S. PATENT DOCUMENTS 1,016,561 A 2/1912 Grabler
1,046,359 A 12/1912 Winton
(Continued)

FOREIGN PATENT DOCUMENTS

CN 201526371 7/2010
CN 106321916 1/2017
(Continued)

OTHER PUBLICATIONS

Graunke, K. et al., "Dynamic Behavior of Labyrinth Seals in Oilfree Labyrinth-Piston Compressors" (1984). International Compressor Engineering Conference. Paper 425. http://docs.lib.purdue.edu/icec/425.

(Continued)

*Primary Examiner* — Thomas N Moulis
(74) *Attorney, Agent, or Firm* — Yohannan Law; David R Yohannan

(57) ABSTRACT

Embodiments of apparatus are disclosed for affecting working fluid flow in a system that delivers material between two locations by carrying the material in the working fluid. For example, embodiments of the disclosed apparatus may be used in an internal combustion engines to carry fuel droplets to a combustion area using air as the working fluid. The apparatus may include a passage including a funnel portion and tumble area that direct working fluid into a stratified stream. The stratified stream may include an outer boundary flow having a toroidal and/or helical flow characteristic and an inner flow carrying injected material that is bound by the outer flow.

27 Claims, 24 Drawing Sheets

(51) Int. Cl.
*F02B 23/10* (2006.01)
*F02M 57/00* (2006.01)

(58) Field of Classification Search
USPC ..... 123/297, 298
See application file for complete search history.

(56) References Cited

U.S. PATENT DOCUMENTS

| | | | |
|---|---|---|---|
| 1,329,559 | A | 2/1920 | Tesla |
| 1,418,838 | A | 6/1922 | Selz |
| 1,511,338 | A | 10/1924 | Cyril |
| 1,527,166 | A | 2/1925 | Maurice |
| 1,639,308 | A | 8/1927 | Orr |
| 1,869,178 | A | 7/1932 | Thuras |
| 1,967,682 | A | 7/1934 | Ochtman, Jr. |
| 1,969,704 | A | 8/1934 | D'Alton |
| 2,025,297 | A | 12/1935 | Meyers |
| 2,224,475 | A | 12/1940 | Evans |
| 2,252,914 | A | 8/1941 | Balton |
| 2,283,567 | A | 5/1942 | Barton |
| 2,442,917 | A | 6/1948 | Butterfield |
| 2,451,271 | A | 10/1948 | Balster |
| 2,468,976 | A | 5/1949 | Herreshoff |
| 2,471,509 | A | 5/1949 | Anderson |
| 2,878,990 | A | 3/1950 | Zurcher |
| 2,644,433 | A | 7/1953 | Anderson |
| 2,761,516 | A | 9/1956 | Vassilkovsky |
| 2,766,839 | A | 10/1956 | Baruch |
| 2,898,894 | A | 8/1959 | Holt |
| 2,915,050 | A | 12/1959 | Allred |
| 2,956,738 | A | 10/1960 | Rosenschold |
| 2,977,943 | A | 4/1961 | Lieberherr |
| 2,979,046 | A | 4/1961 | Hermann |
| 3,033,184 | A | 5/1962 | Jackson |
| 3,035,879 | A | 5/1962 | Jost |
| 3,113,561 | A | 12/1963 | Heintz |
| 3,143,282 | A | 8/1964 | McCrory |
| 3,154,059 | A | 10/1964 | Witzky |
| 3,171,425 | A | 3/1965 | Berlyn |
| 3,275,057 | A | 9/1966 | Trevor |
| 3,399,008 | A | 8/1968 | Farrell |
| 3,409,410 | A | 11/1968 | Spence |
| 3,491,654 | A | 1/1970 | Zurcher |
| 3,534,771 | A | 10/1970 | Everdam |
| 3,621,821 | A | 11/1971 | Jarnuszkiewicz |
| 3,749,318 | A | 7/1973 | Cottell |
| 3,881,459 | A | 5/1975 | Gaetcke |
| 3,892,070 | A | 7/1975 | Bose |
| 3,911,753 | A | 10/1975 | Daub |
| 3,973,532 | A | 8/1976 | Litz |
| 4,043,224 | A | 8/1977 | Quick |
| 4,046,028 | A | 9/1977 | Vachris |
| 4,077,429 | A | 3/1978 | Kimball |
| 4,127,332 | A | 11/1978 | Thiruvengadam |
| 4,128,388 | A | 12/1978 | Freze |
| 4,164,988 | A | 8/1979 | Virva |
| 4,182,282 | A | 1/1980 | Pollet |
| 4,185,597 | A | 1/1980 | Cinquegrani |
| 4,271,803 | A | 6/1981 | Nakanishi |
| 4,300,499 | A | 11/1981 | Nakanishi |
| 4,312,305 | A | 1/1982 | Noguchi |
| 4,324,214 | A | 4/1982 | Garcea |
| 4,331,118 | A | 5/1982 | Cullinan |
| 4,332,229 | A | 6/1982 | Schuit |
| 4,343,605 | A | 8/1982 | Browning |
| 4,357,916 | A | 11/1982 | Noguchi |
| 4,383,508 | A | 5/1983 | Irimajiri |
| 4,467,752 | A | 8/1984 | Yunick |
| 4,480,597 | A | 11/1984 | Noguchi |
| 4,488,866 | A | 12/1984 | Schirmer |
| 4,541,377 | A | 9/1985 | Amos |
| 4,554,893 | A | 11/1985 | Vecellio |
| 4,570,589 | A | 2/1986 | Fletcher |
| 4,576,126 | A | 3/1986 | Ancheta |
| 4,592,318 | A | 6/1986 | Pouring |
| 4,597,342 | A | 7/1986 | Green |
| 4,598,687 | A | 7/1986 | Hayashi |
| 4,669,431 | A | 6/1987 | Simay |
| 4,715,791 | A | 12/1987 | Berlin |
| 4,724,800 | A | 2/1988 | Wood |
| 4,756,674 | A | 7/1988 | Miller |
| 4,788,942 | A | 12/1988 | Pouring |
| 4,836,154 | A | 6/1989 | Bergeron |
| 4,874,310 | A | 10/1989 | Seemann |
| 4,879,974 | A | 11/1989 | Alvers |
| 4,919,611 | A | 4/1990 | Flament |
| 4,920,937 | A | 5/1990 | Sasaki |
| 4,936,269 | A | 6/1990 | Beaty |
| 4,969,425 | A | 11/1990 | Slee |
| 4,990,074 | A | 2/1991 | Nakagawa |
| 4,995,349 | A | 2/1991 | Tuckey |
| 5,004,066 | A | 4/1991 | Furukawa |
| 5,007,392 | A | 4/1991 | Niizato |
| 5,020,504 | A | 6/1991 | Morikawa |
| 5,083,539 | A | 1/1992 | Cornelio |
| 5,154,141 | A | 10/1992 | McWhorter |
| 5,168,843 | A | 12/1992 | Franks |
| 5,213,074 | A | 5/1993 | Imagawa |
| 5,222,879 | A | 6/1993 | Kapadia |
| 5,251,817 | A | 10/1993 | Ursic |
| 5,343,618 | A | 9/1994 | Arnold |
| 5,357,919 | A | 10/1994 | Ma |
| 5,390,634 | A | 2/1995 | Walters |
| 5,397,180 | A | 3/1995 | Miller |
| 5,398,645 | A | 3/1995 | Haman |
| 5,454,712 | A | 10/1995 | Yap |
| 5,464,331 | A | 11/1995 | Sawyer |
| 5,479,894 | A | 1/1996 | Noltemeyer |
| 5,694,891 | A | 12/1997 | Liebich |
| 5,714,721 | A | 2/1998 | Gawronski |
| 5,779,461 | A | 7/1998 | Iizuka |
| 5,791,303 | A | 8/1998 | Skripov |
| 5,872,339 | A | 2/1999 | Hanson |
| 5,937,821 | A | 8/1999 | Oda |
| 5,957,096 | A | 9/1999 | Clarke |
| 6,003,488 | A | 12/1999 | Roth |
| 6,019,188 | A | 2/2000 | Nevill |
| 6,119,648 | A | 9/2000 | Araki |
| 6,138,616 | A | 10/2000 | Svensson |
| 6,138,639 | A | 10/2000 | Hiraya |
| 6,199,369 | B1 | 3/2001 | Meyer |
| 6,205,962 | B1 | 3/2001 | Berry, Jr. |
| 6,237,164 | B1 | 5/2001 | LaFontaine |
| 6,257,180 | B1 | 7/2001 | Klein |
| 6,363,903 | B1 | 4/2002 | Hayashi |
| 6,382,145 | B2 | 5/2002 | Matsuda |
| 6,418,905 | B1 | 7/2002 | Baudlot |
| 6,446,592 | B1 | 9/2002 | Wilksch |
| 6,474,288 | B1 | 11/2002 | Blom |
| 6,494,178 | B1 | 12/2002 | Cleary |
| 6,508,210 | B2 | 1/2003 | Knowlton |
| 6,508,226 | B2 | 1/2003 | Tanaka |
| 6,536,420 | B1 | 3/2003 | Cheng |
| 6,639,134 | B2 | 10/2003 | Schmidt |
| 6,668,703 | B2 | 12/2003 | Gamble |
| 6,682,313 | B1 | 1/2004 | Sulmone |
| 6,691,932 | B1 | 2/2004 | Schultz |
| 6,699,031 | B2 | 3/2004 | Kobayashi |
| 6,705,281 | B2 | 3/2004 | Okamura |
| 6,718,938 | B2 | 4/2004 | Szorenyi |
| 6,758,170 | B1 | 7/2004 | Walden |
| 6,769,390 | B2 | 8/2004 | Hattori |
| 6,814,046 | B1 | 11/2004 | Hiraya |
| 6,832,589 | B2 | 12/2004 | Kremer |
| 6,834,626 | B1 | 12/2004 | Holmes |
| 6,971,379 | B2 | 12/2005 | Sakai |
| 6,973,908 | B2 | 12/2005 | Paro |
| 7,013,863 | B2 * | 3/2006 | Shiraishi ..... F02F 1/4214 123/295 |
| 7,074,992 | B2 | 7/2006 | Schmidt |
| 7,150,609 | B2 | 12/2006 | Kiem |
| 7,261,079 | B2 | 8/2007 | Gunji |
| 7,296,545 | B2 | 11/2007 | Ellingsen, Jr. |
| 7,341,040 | B1 | 3/2008 | Wiesen |

(56) References Cited

U.S. PATENT DOCUMENTS

| | | | | |
|---|---|---|---|---|
| 7,360,531 | B2 | 4/2008 | Yohso | |
| 7,452,191 | B2 | 11/2008 | Tell | |
| 7,559,298 | B2 | 7/2009 | Cleeves | |
| 7,576,353 | B2 | 8/2009 | Diduck | |
| 7,584,820 | B2 | 9/2009 | Parker | |
| 7,628,606 | B1 | 12/2009 | Browning | |
| 7,634,980 | B2 | 12/2009 | Jarnland | |
| 7,717,701 | B2 | 5/2010 | D'Agostini | |
| 7,810,479 | B2 | 10/2010 | Naquin | |
| 7,900,454 | B2 | 3/2011 | Schoell | |
| 7,984,684 | B2 | 7/2011 | Hinderks | |
| 8,037,862 | B1 | 10/2011 | Jacobs | |
| 8,215,292 | B2 | 7/2012 | Bryant | |
| 8,251,040 | B2 | 8/2012 | Jang | |
| 8,284,977 | B2 | 10/2012 | Ong | |
| 8,347,843 | B1 | 1/2013 | Batiz-Vergara | |
| 8,385,568 | B2 | 2/2013 | Goel | |
| 8,455,056 | B1 * | 6/2013 | Browning | F23D 14/52 239/79 |
| 8,479,871 | B2 | 7/2013 | Stewart | |
| 8,640,669 | B2 | 2/2014 | Nakazawa | |
| 8,656,870 | B2 | 2/2014 | Surnilla | |
| 8,714,135 | B2 | 5/2014 | Anderson | |
| 8,776,759 | B2 | 7/2014 | Cruz | |
| 8,800,527 | B2 | 8/2014 | McAlister | |
| 8,827,176 | B2 | 9/2014 | Browning | |
| 8,857,405 | B2 | 10/2014 | Attard | |
| 8,863,724 | B2 | 10/2014 | Shkolnik | |
| 8,919,321 | B2 | 12/2014 | Burgess | |
| 9,175,736 | B2 | 11/2015 | Greuel | |
| 9,289,874 | B1 | 3/2016 | Sabo | |
| 9,309,807 | B2 | 4/2016 | Burton | |
| 9,441,573 | B1 | 9/2016 | Sergin | |
| 9,512,779 | B2 | 12/2016 | Redon | |
| 9,736,585 | B2 | 8/2017 | Pattok | |
| 9,739,382 | B2 | 8/2017 | Laird | |
| 9,822,968 | B2 | 11/2017 | Tamura | |
| 9,854,353 | B2 | 12/2017 | Wang | |
| 9,938,927 | B2 | 4/2018 | Ando | |
| 2002/0114484 | A1 | 8/2002 | Crisco | |
| 2002/0140101 | A1 | 10/2002 | Yang | |
| 2003/0104328 | A1 * | 6/2003 | Kobayashi | F23L 7/007 431/10 |
| 2003/0111122 | A1 | 6/2003 | Horton | |
| 2005/0036896 | A1 | 2/2005 | Navarro | |
| 2005/0087166 | A1 | 4/2005 | Rein | |
| 2005/0155645 | A1 | 7/2005 | Freudendahl | |
| 2005/0257837 | A1 | 11/2005 | Bailey | |
| 2006/0230764 | A1 | 10/2006 | Schmotolocha | |
| 2007/0039584 | A1 | 2/2007 | Ellingsen, Jr. | |
| 2007/0101967 | A1 | 5/2007 | Pegg | |
| 2008/0169150 | A1 | 7/2008 | Kuo | |
| 2008/0184878 | A1 | 8/2008 | Chen | |
| 2008/0185062 | A1 | 8/2008 | Johannes Nijland | |
| 2009/0286190 | A1 * | 11/2009 | Browning | F23D 14/04 431/9 |
| 2010/0071640 | A1 | 3/2010 | Mustafa | |
| 2011/0030646 | A1 | 2/2011 | Barry | |
| 2011/0132309 | A1 | 6/2011 | Turner | |
| 2011/0139114 | A1 | 6/2011 | Nakazawa | |
| 2011/0235845 | A1 | 9/2011 | Wang | |
| 2012/0103302 | A1 | 5/2012 | Attard | |
| 2012/0114148 | A1 | 5/2012 | Goh Kong San | |
| 2012/0186561 | A1 | 7/2012 | Bethel | |
| 2013/0036999 | A1 | 2/2013 | Levy | |
| 2013/0327039 | A1 | 12/2013 | Schenker et al. | |
| 2014/0056747 | A1 | 2/2014 | Kim | |
| 2014/0109864 | A1 | 4/2014 | Drachko | |
| 2014/0199837 | A1 | 7/2014 | Hung | |
| 2014/0361375 | A1 | 12/2014 | Deniz | |
| 2015/0059718 | A1 | 3/2015 | Claywell | |
| 2015/0153040 | A1 | 6/2015 | Rivera Garza | |
| 2015/0167536 | A1 | 6/2015 | Toda et al. | |
| 2015/0184612 | A1 | 7/2015 | Takada et al. | |
| 2015/0337878 | A1 | 11/2015 | Schlosser | |
| 2015/0354570 | A1 | 12/2015 | Karoliussen | |
| 2016/0017839 | A1 | 1/2016 | Johnson | |
| 2016/0064518 | A1 | 3/2016 | Liu | |
| 2016/0258347 | A1 | 9/2016 | Riley | |
| 2016/0265416 | A1 | 9/2016 | Ge | |
| 2016/0348611 | A1 | 12/2016 | Suda et al. | |
| 2016/0348659 | A1 | 12/2016 | Pinkerton | |
| 2016/0356216 | A1 | 12/2016 | Klyza | |
| 2017/0248099 | A1 | 8/2017 | Wagner | |
| 2017/0260725 | A1 | 9/2017 | McAlpine | |
| 2018/0096934 | A1 | 4/2018 | Siew | |
| 2018/0130704 | A1 | 5/2018 | Li | |

FOREIGN PATENT DOCUMENTS

| | | |
|---|---|---|
| CN | 206131961 | 4/2017 |
| DE | 19724225 | 12/1998 |
| EP | 0025831 | 4/1981 |
| EP | 2574796 | 4/2013 |
| FR | 1408306 | 8/1965 |
| FR | 2714473 | 6/1995 |
| GB | 104331 | 1/1918 |
| GB | 139271 | 3/1920 |
| GB | 475179 | 11/1937 |
| GB | 854135 | 11/1960 |
| GB | 1437340 | 5/1976 |
| GB | 1504279 | 3/1978 |
| GB | 1511538 | 5/1978 |
| GB | 2140870 | 12/1984 |
| JP | S5377346 | 7/1978 |
| JP | S5833393 | 2/1983 |
| JP | 58170840 | 10/1983 |
| JP | S5973618 | 4/1984 |
| JP | H02211357 | 8/1990 |
| JP | H0638288 | 5/1994 |
| JP | 2000064905 | 3/2000 |
| JP | 2003065013 | 3/2003 |
| JP | 5535695 | 7/2014 |
| TW | 201221753 | 6/2012 |
| WO | 1983001485 | 4/1983 |
| WO | 2006046027 | 5/2006 |
| WO | 2007065976 | 6/2007 |
| WO | 2010118518 | 10/2010 |
| WO | 2016145247 | 9/2016 |

OTHER PUBLICATIONS

International Searching Authority Search Report and Written Opinion for application PCT/US2018/024102, dated Jun. 25, 2018, 10 pages.

International Searching Authority Search Report and Written Opinion for application PCT/US2018/024477, dated Jul. 20, 2018, 14 pages.

International Searching Authority Search Report and Written Opinion for application PCT/US2018/024485, dated Jun. 25, 2018, 16 pages.

International Searching Authority Search Report and Written Opinion for application PCT/US2018/024844, dated Jun. 8, 2018, 9 pages.

International Searching Authority Search Report and Written Opinion for application PCT/US2018/024852, dated Jun. 21, 2018, 9 pages.

International Searching Authority Search Report and Written Opinion for application PCT/US2018/025133, dated Jun. 28, 2018, 9 pages.

International Searching Authority Search Report and Written Opinion for application PCT/US2018/025151, dated Jun. 25, 2018, 14 pages.

International Searching Authority Search Report and Written Opinion for application PCT/US2018/025471, dated Jun. 21, 2018, 10 pages.

International Searching Authority Search Report and Written Opinion for application PCT/US2018/029947, dated Jul. 26, 2018, 12 pages.

International Searching Authority Search Report and Written Opinion for application PCT/US2018/030937, dated Jul. 9, 2018, 7 pages.

(56) References Cited

OTHER PUBLICATIONS

International Searching Authority Search Report and Written Opinion for application PCT/US2018/053264, dated Dec. 3, 2018, 10 pages.
International Searching Authority Search Report and Written Opinion for application PCT/US2018/053350, dated Dec. 4, 2018, 7 pages.
International Searching Authority Search Report and Written Opinion for application PCT/US2019/014936, dated Apr. 18, 2019, 9 pages.
International Searching Authority Search Report and Written Opinion for application PCT/US2019/015189, dated Mar. 25, 2019, 10 pages.
Keller, L. E., "Application of Trunk Piston Labyrinth Compressors in Refrigeration and Heat Pump Cycles" (1992). International Compressor Engineering Conference. Paper 859. http://docs.lib.purdue.edu/icec/859.
Quasiturbine Agence, "Theory—Quasiturbine Concept" [online], Mar. 5, 2005 (Mar. 5, 2005), retrieved from the internet on Jun. 29, 2018) URL:http://quasiturbine.promci.qc.ca/ETheoryQTConcept.htm; entire document.
Vetter, H., "The Sulzer Oil-Free Labyrinth Piston Compressor" (1972). International Compressor Engineering Conference. Paper 33. http://docs.lib.purdue.edu/icec/33.

* cited by examiner

METHOD AND APPARATUS FOR PRODUCING STRATIFIED STREAMS

CROSS REFERENCE TO RELATED APPLICATIONS

This application relates to and claims the priority of U.S. Provisional Patent Application No. 62/622,645, which was filed Jan. 26, 2018.

FIELD OF THE INVENTION

Embodiments of the present invention relate generally to methods and apparatus for producing a stratified stream fluid flow.

BACKGROUND OF THE INVENTION

Many systems and processes utilize the flow of a working fluid, such as air for example, to deliver material from one location to another. In such systems and processes, the working fluid and the material to be delivered may be mixed together relatively uniformly. Uniform dispersal of the material to be delivered in the working fluid may be disadvantageous however. For example, relatively uniform dispersal of fuel droplets in the intake air of an internal combustion engine ignition and combustion system may not produce optimum combustion of the fuel in terms of percentage of fuel ignited, fuel consumption, flame propagation, and combustion timing, among other metrics. The fuel dispersed in the outer edges of the air intake flow may be under utilized for combustion, in particular.

Uniform dispersal of a material to be delivered in a working fluid may also be suboptimal for other reasons. For example, the working fluid nearest to the walls of a passage through which it is traveling encounter frictional forces at the boundary between the flow and the wall. This friction results in drag on the flow, creates heat and turbulence, and may result in deposits of material along the wall.

The efficient and controlled delivery of material in such systems and processes may be improved by using a stratified stream of working fluid that includes at least two distinct flow layers or regions. A stratified stream may include an inner flow stream of working fluid that contains a relatively heavier concentration of the material to be delivered, and an outer flow stream of working fluid that contains a lower concentration of the material to be delivered. The outer stream of working fluid may act as a low friction boundary disposed between the inner flow stream and the wall of the passage through which the working fluid travels. The flow lines of the outer stream and the inner stream may be different in keeping with the different purposes of each. The outer stream may tend to flow in a toroidal and/or helical motion to serve as a boundary in a circular cross-section passage, while the inner stream may tend to have a more laminar flow in line with the longitudinal axis of a circular cross-section passage.

A stratified system may provide improved flow of a working fluid for applications such as, but not limited to, internal combustion engines, culinary preparation, painting/coating, 3D printing, additive manufacturing, burners, torches, aerators, stoves, grills, ovens, fireplaces, heating systems, rocket stoves, rocket mass stoves, masonry ovens, masonry fireplaces, audio speakers, welding and cutting applications, thruster and hull friction reduction, and other consumer/industrial/commercial/scientific products.

With regard to internal combustion engines, for example, embodiments of the present invention may provide improved lean fuel ratio ignition and combustion. In this regard, embodiments of the present invention may provide an improvement over the Turbulent Jet Ignition Pre-Chamber Combustion System for Spark Ignition Engines invented by William Attard and produced by Mahle Motorsports. Like improvements over the designs for delivery of materials using a working fluid may be realized for all of the above noted applications, as well as for others known and yet to be developed.

OBJECTS OF THE INVENTION

Accordingly, it is an object of some, but not necessarily all, embodiments of the present invention to provide an improved method of fuel injection and ignition. Some embodiments of the present invention may produce an outer flow stream having toroidal and/or helical toroidal and/or conical helical toroidal flow characteristics. This may allow the central region of the stream to contain a larger proportion of the fuel and deliver the fuel to a sparkplug or glow-plug protruding into the central region. The central region of the stratified stream may be a near stochiometric mix due to the oxygen within the central region being the only easily available oxygen for chemical reaction at the time of ignition. This may make it easier and more consistent to ignite the charge when the stratified stream is overall chemically lean. The outer region of the stratified stream may be moving in a coherent motion, which may maintain its integrity until the rotation sufficiently slows. When the combustion motion of the central region of the flow overtakes the motion of the outer region, the excess air may mix into the burning charge as the stream continues swirling and tumbling, causing it to rapidly burn and to be further cooled. Some embodiments of the present invention may be applied to two-stroke cycle, four-stroke cycle, multi-stroke cycle, rotary, turbine, and jet internal combustion engines, as well as steam engines and other external combustion engines. These engines may be naturally aspirated or utilize volumetric efficiency enhancement via boosted intake pressure, ram effects, tuned manifolds, and/or other similar traditional methods.

It is a still further object of some, but not necessarily all, embodiments of the present invention to improve the internal combustion engine by reducing fuel consumption.

It is a still further object of some, but not necessarily all, embodiments of the present invention to provide improved swirl and squish.

It is a still further object of some, but not necessarily all, embodiments of the present invention to provide an increased fuel burn rate. This may allow lower exhaust temperature with higher oxygen content. This also may allow the use of diesel as well as slower burning fuels, such as hydrogen and some alcohols, while still allowing more injection and ignition timing versatility.

It is a still further object of some, but not necessarily all, embodiments of the present invention to create significantly less nitrous oxide compounds due to lower peak combustion temperatures.

It is a still further object of some, but not necessarily all, embodiments of the present invention to thermally isolate the burning charge from the chamber walls of internal combustion engines.

It is a still further object of some, but not necessarily all, embodiments of the present invention to prevent wall and corner quenching of the burning charge in internal combustion engines.

It is a still further object of some, but not necessarily all, embodiments of the present invention to provide a system of enhancements which when considered as a whole allow an existing engine design to run at higher RPMs.

It is a still further object of some, but not necessarily all, embodiments of the present invention to prevent effacing and scorching of the oil coating on the combustion chamber walls of internal combustion engines.

It is a still further object of some, but not necessarily all, embodiments of the present invention to prevent the collection of fuel in chamber corners and catch spaces, such as above piston rings in internal combustion engines.

It is a still further object of some, but not necessarily all, embodiments of the present invention to be fully compatible with port and/or direct water/water blend injection in internal combustion engines.

It is a still further object of some, but not necessarily all, embodiments of the present invention to allow significant and controllable adjustment of the injection and ignition timing by currently available engine management computers.

It is a still further object of some, but not necessarily all, embodiments of the present invention to allow multiple injection/ignition events during the combustion cycle of internal combustion engines.

It is a still further object of some, but not necessarily all, embodiments of the present invention to be fully compatible with turbocharger anti-lag strategies in internal combustion engines.

It is a still further object of some, but not necessarily all, embodiments of the present invention to inject all or a portion of the necessary fuel into the combustion chamber as a burning stratified stream in internal combustion engines.

It is a still further object of some, but not necessarily all, embodiments of the present invention to allow carbureted applications, throttle body injected applications, and intake manifold applications with or without port injection/wet fogging in internal combustion engines.

It is a still further object of some, but not necessarily all, embodiments of the present invention to allow passage diameter, path shape, and path length to be tuned for a ramming effect to further increase combustion chamber pressure in internal combustion engines.

It is a still further object of some, but not necessarily all, embodiments of the present invention to allow the tuning of the vortex motion and tumble (i.e., controlled turbulence) by adding a nozzle and/or by modifying the working pressures, geometric patterns, shapes, locations, and/or feature height/depth in a tumble area. Some embodiments may tuned for optimal planes/axis of motion of the turbulence, symmetry/asymmetry of the turbulence, turbulence rotational direction for one or more axis of motion, amount of turbulence, relative sizes of the stream components to each other, coherent shape(s) of the turbulence, time length of turbulence coherence, and/or turbulence travel distance. Accordingly, embodiments of the present invention may be designed or tuned for differing engine combustion chamber geometries and design goals. Some embodiments may also be tuned for power-band effects since the coherence tends to be time based, which may allow the system to have a proper ratio of coherence relative to the combustion cycle time. The tuning of these effects may allow for proper loss of coherence for low RPMs, while maintaining the coherence further into the combustion cycle for high RPMs as the chamber loading time decreases significantly into the higher RPMs.

It is a still further object of some, but not necessarily all, embodiments of the present invention to also have application to various consumer, industrial, scientific, and commercial processes. Some of the many possible applications include painting/coating spray systems, dispensing/spraying applications such as agricultural spraying/fire suppression systems/fire-fighting gear, 3D printing/additive manufacturing, burners, torches, aerators, stoves/grills/ovens/fireplaces, other heating applications such as rocket stoves/rocket mass stoves/masonry ovens, foamed material manufacturing, and many culinary applications such as coffee foaming/dispensing, dough/batter foaming/dispensing, mayonnaise/margarine manufacturing, etc. Some embodiments of the present invention may permit stoves, ovens, grills, and fireplaces to have increased pressure and scrubbing action within the combustion chamber and exhaust to increase fuel burn rate by improved airflow which tends to burn off creosote and other undesirable emissions. Some embodiments of the present invention also may allow increased heating application efficiency by using less fuel for the same heat extraction by tailoring the turbulence to break around the heat-exchanger/thermal mass and thereby improve heat transfer. Some embodiments of the present invention may improve through-put and efficiency of processes by allowing batch processes to be converted to continuous processes. Some embodiments of the present invention may also enhance desirable qualities in culinary processes such as lightness or fluffiness.

It is a still further object of some, but not necessarily all, embodiments of the present invention to provide increased air movement, improved mixing and stream focus, increased through-put for foamed and emulsion processes, increased through-put for fluidized materials, easy to clean/sanitize/service components, less unreacted/un-combusted products, less partial reaction/combustion compounds, decreased reaction/combustion chamber residue, increased reaction/burn rate, less undesirable emissions, and improved efficiency. Some embodiments of the invention using a multi-layer nozzle may be configured to provide a short time-delay based coherence to improve mixing at the tip of the nozzle for culinary, paint/coating, dispensing/spraying applications, burner, torch, aerator, stove/oven/grill/fireplace, and/or other heating applications. Some embodiments of the invention using a multi-layer nozzle may be configured to provide a long time-delay based coherence to allow insulation from the reaction/combustion chamber allowing better heat and pressure retention to increase reaction efficiency. The coherent motion of the outer stream area may also be tuned to allow the coherence to break at the proper distance from the nozzle to increase heat transfer to heat-exchangers for particular burner, torch, aerator, stove/oven/grill/fireplace, and/or other heating applications.

It is a still further object of some, but not necessarily all, embodiments of the present invention to have application to fluidized materials and fluidized bed reaction vessels. The coherent motion of the outer stream area may allow solid particles to be suspended within the center area of the stream and therefore fluidized. Embodiments of the present invention may further enhance the liquid-like movement and behavior of properly prepared solids and allow them to chemically interact more like liquids or gases with proper system design.

It is a still further object of some, but not necessarily all, embodiments of the present invention to have application to gas or fluid nozzle implementations, such as shielding gas during welding. The welding material and/or shielding gas may be inserted in the center of the stream and maintained by other higher-pressure gasses or fluids in the outer coherent turbulent area over the weld. This may reduce shielding gas and/or flux usage during welding applications. It may even allow gases to more easily displace water or other fluids for underwater welding or similar applications due to the coherence of the stream boundaries.

It is a still further object of some, but not necessarily all, embodiments of the present invention to allow a longer coherence past the end of a nozzle. This may allow many useful applications including applications in water/plasma cutting and various etching processes. A plasma stream may be formed in the center stream region and maintain coherence longer to allow a greater working distance from the cutting material surface and/or a more focused and deeper material penetration. A similar application may also be possible with electron beam welding if the electron beam is maintained within the central section of the stratified stream.

It is a still further object of some, but not necessarily all, embodiments of the present invention to allow possible applications in water jetting nozzles in marine craft, such as jet skis, in aircraft, in spacecraft, such as ion thrusters, and in other thrust/nozzle applications. Some embodiments of the invention may allow the central stream to be surrounded by coherent turbulence, which may allow a more tightly focused pressure stream and increased thruster efficiency. Some embodiments may also allow the injection of air bubbles into the center or outer region of the stratified stream. The coherence of the stream may allow the stratified stream and/or the air bubbles within to cling to a ship hull for a longer time, which may decrease hull drag in the water and increases the efficiency of the application.

These and other advantages of some, but not necessarily all, embodiments of the present invention will be apparent to those of ordinary skill in the art.

SUMMARY OF EMBODIMENTS OF THE INVENTION

Responsive to the foregoing challenges, Applicant has developed an innovative stratified stream system comprised of: a passage extending from an input port to an exit port, said passage configured to receive a supply of working fluid at the input port; a funnel portion in said passage, said funnel portion having a greater flux area at a point proximal to the input port than at a point distal from the input port; and a tumble area provided in said passage between the funnel portion and the exit port, wherein the funnel portion and tumble area are configured to induce the working fluid to form a stratified stream having an outer portion of the working fluid having a toroidal flow characteristic and an inner portion of the working fluid surrounded by the outer portion of the working fluid.

Applicant has further developed an innovative stratified stream system comprised of: a passage extending from an input port to an exit port; a funnel portion in said passage; and a tumble area having a non-smooth surface, said tumble area provided in said passage between the funnel portion and the exit port, wherein the funnel portion and tumble area are configured to induce the working fluid to form a stratified stream having an outer portion of the working fluid having a toroidal flow characteristic and an inner portion of the working fluid surrounded by the outer portion of the working fluid.

Applicant has still further developed an innovative method of providing a stream of material using a working fluid comprising the steps of: passing the working fluid through a funnel and a tumble area to induce the working fluid to form a stratified stream having an outer portion of the working fluid with a toroidal flow characteristic and an inner portion of the working fluid surrounded by the outer portion of working fluid; and injecting the material into the inner portion of the working fluid.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
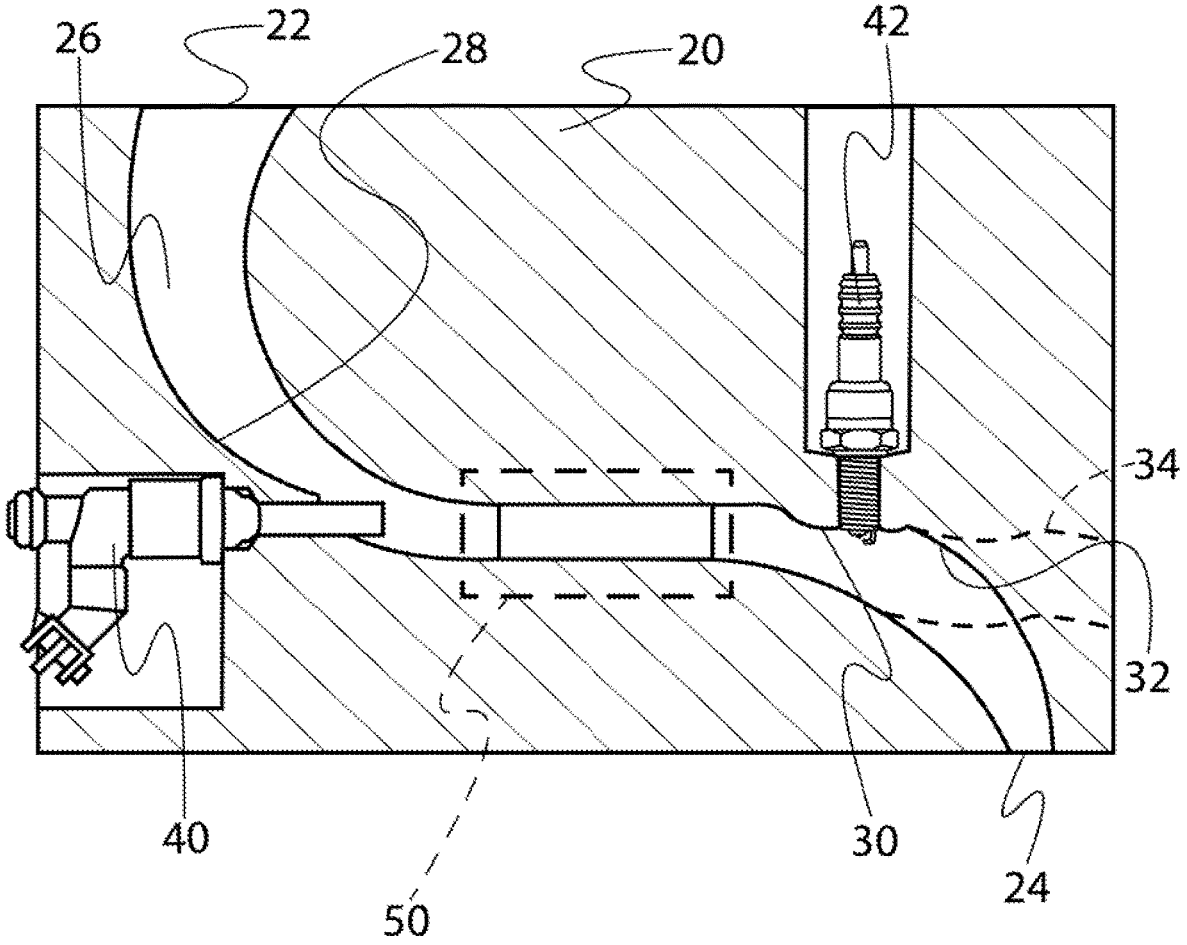
FIG. 1 is a side cross-sectional view of a first internal combustion engine injection and ignition system embodiment of the present invention.

Reference will now be made in detail to embodiments of the present invention, examples of which are illustrated in the accompanying drawings. With reference to FIG. 1, a first internal combustion engine injection and ignition system embodiment formed in a main body 20 is shown. The main body 20 may be part of a cylinder head, an engine block, and/or other engine component, for example. The main body 20 may define a space, such as a continuous fluid passage, chamber or channel, extending from an input port 22, through a funnel portion 26, a tumble area 50 and an expansion portion 32, consecutively, to an exit port 24. An alternative embodiment may incorporate an expansion portion and exit port passage 34 that is more in line with the tumble area 50.

The fluid passage may be generally cylindrical as viewed in cross-section taken along its longitudinal axis over a majority of its length. Some interruptions in the generally cylindrical cross-sectional shape of the fluid passage may be present. The funnel portion 26 may be curved along its longitudinal axis, and may have a decreasing diameter when measured along the longitudinal axis as it extends away from the input port 22. In other words, the funnel portion 26 may have a greater flux area at a point proximal to the input port 22 than at a point distal from the input port. The curvature and diameter of the funnel portion 26 may be selected to generate fluid tumble (a type of controlled turbulence) along the walls of the tumble area 50. In the FIG. 1 embodiment, the tumble area 50 may comprise a straight and generally smooth wall cylindrical passage extending in a longitudinal direction set generally at a right angle to the longitudinal axis of the fluid passage taken near or at the input port 22.

When the embodiment illustrated in FIG. 1 is used for fuel ignition in an internal combustion engine, air may be provided to the system at an ambient or boost pressure at the input port 22. The air flows from the input port 22 into the funnel portion 26. The funnel portion 26 may include an integrated injector ramp 28 to reduce transitional air flow turbulence over the exposed nozzle of a fuel injector 40. The funnel portion 26 may transition to or lead to a tumble area 50 which may be formed by a straight, smooth walled cylindrical passage. The decreasing diameter and curvature of the funnel portion 26 may be selected to induce a Venturi effect and a Coanda effect, which may cause the flowing air to tumble into the tumble area 50. As a result, areas of varying vorticity may be produced along the passage walls. The funnel portion 26 and tumble area 50 may be configured to induce the working fluid to form a stratified stream having an outer portion of the working fluid having a toroidal flow characteristic, and an inner portion of the working fluid surrounded by the outer portion of the working fluid. The funnel portion 26 and the tumble area 50 may also be configured to maintain the integrity of the stratified stream flows (outer and inner) past the end of the tumble area proximal to the exit port 24.

Figure 15:
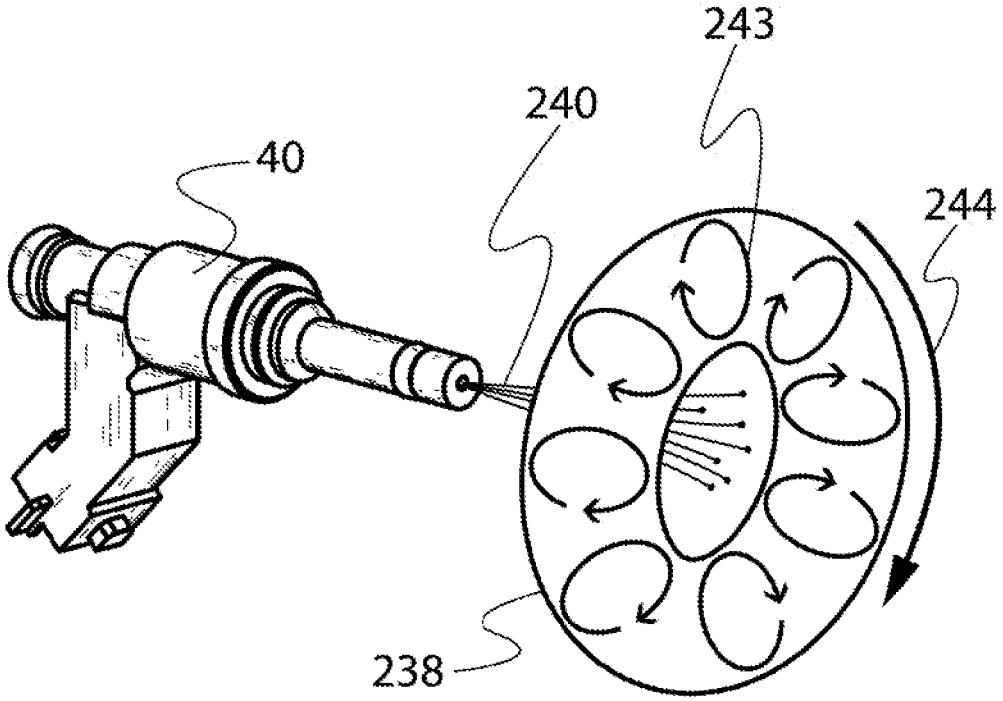
FIG. 15 is a pictorial view of a fuel injector and injected fuel stream bound by a rotating toroidal stratified fluid stream in accordance with embodiments of the invention.

With reference to FIGS. 1 and 15, the air/fuel mixture passing through the tumble area 50 may have a tendency to spin and tumble, as is conceptually illustrated in FIG. 15. A central stream of smooth or mostly laminar flow of working fluid may be linearly accelerated due to tangential forces and the reduced drag imparted by the motion of the outer stream vortex ring 238 surrounding the central stream. The central stream may have a fuel stream 240 added by the fuel injector 40 for engine applications. Some, but not all, embodiments of the invention may include a fuel injector 40 to create a central stream which is populated with fuel and a coherent (i.e., controlled turbulence) outer stream which contains mostly air. More specifically, a vortex ring 238 of air or mostly air may be formed within the passage between the tumble area 50 and the sparkplug ramp 30. The vortex ring 238 may exhibit two motions—a poloidal flow 243 within the vortex ring and a clockwise toroidal flow 244 which may tend to cause the vortex ring to rotate about its central axis. The poloidal flow 243 may be induced as the air tumbles over itself at foci coincident on a smaller offset ring located along the distance of the passage which forms the toroidal shaped vortex ring 238. This toroidal shaped vortex ring 238 may form the core coherence of the outer stream of working fluid. The outer stream itself may also tend to rotate about the central body foci of the toroid, therefore inducing a clockwise toroidal flow 244 by rotating the entire toroid about the central body foci. The clockwise toroidal flow 244 can be rather weak when compared with the poloidal flow 243 in the implementation shown in FIG. 1, but it may be stronger in other embodiments—which may increase the coherent motion time of the outer stream.

Since the coherence may be driven by induced turbulence from the movement of the air, the coherent motion time of the outer stream may be directly proportional to the coherent motion imparted. This motion may be dependent upon the geometry used to induce it, the parameters of the air provided at the input port 22 (e.g., temperature and pressure), assisting induced coherent motions created by the geometry, and the effects of reflected and/or resonant pressure waves within the fluid passage. These variables may be tuned to induce a broad or a singularly peaked power-band effect upon the stratified stream.

With continued reference to FIG. 1, in an engine embodiment, the air may continue to tumble around the fluid passage edges as it progresses over the sparkplug ramp 30. The sparkplug ramp 30 may deflect the tumbling air and allow the sparkplug 42 to be located within the central area of the stratified stream. This central area of the stream may be ignited, as the sparkplug tends to be enveloped within the area of fuel. The injected fuel also tends to be vaporized and mixed within the central area of the stream due to the pressure and intimate contact within the flow. The design of the sparkplug ramp 30 may also contribute a swirling motion encompassing the sparkplug 42 which assists in properly mixing the fuel. A reduced sparkplug gap may be required to prevent spark blowout not unlike that experienced in turbocharger and supercharger applications. The remaining part of the fluid passage beyond the sparkplug 42 may be curved and may include an expansion area 32 which allows the expanding ignited gas to gain some swirl as well create a brief anti-backflow pressure wave before being ejected through the exit port 24 into the combustion chamber. Fuel injection paths used for internal combustion engine purposes may nearly intersect the ignition electrode region of the sparkplug 42 to provide a path across the hot sparkplug tip to improve ignition characteristics.

Figure 2:
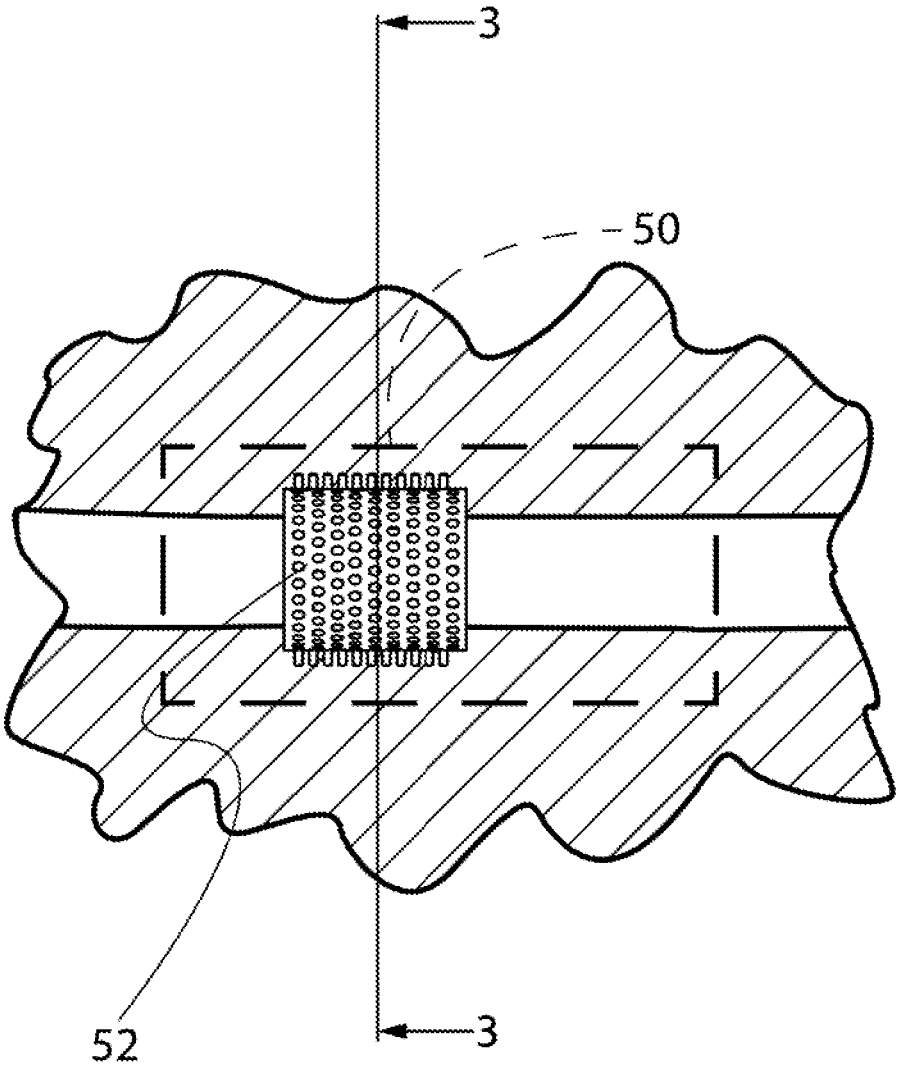
FIG. 2 is a side cross-sectional view of a tumble area constructed in accordance with a second internal combustion engine injection and ignition system embodiment of the present invention.
Figure 3:
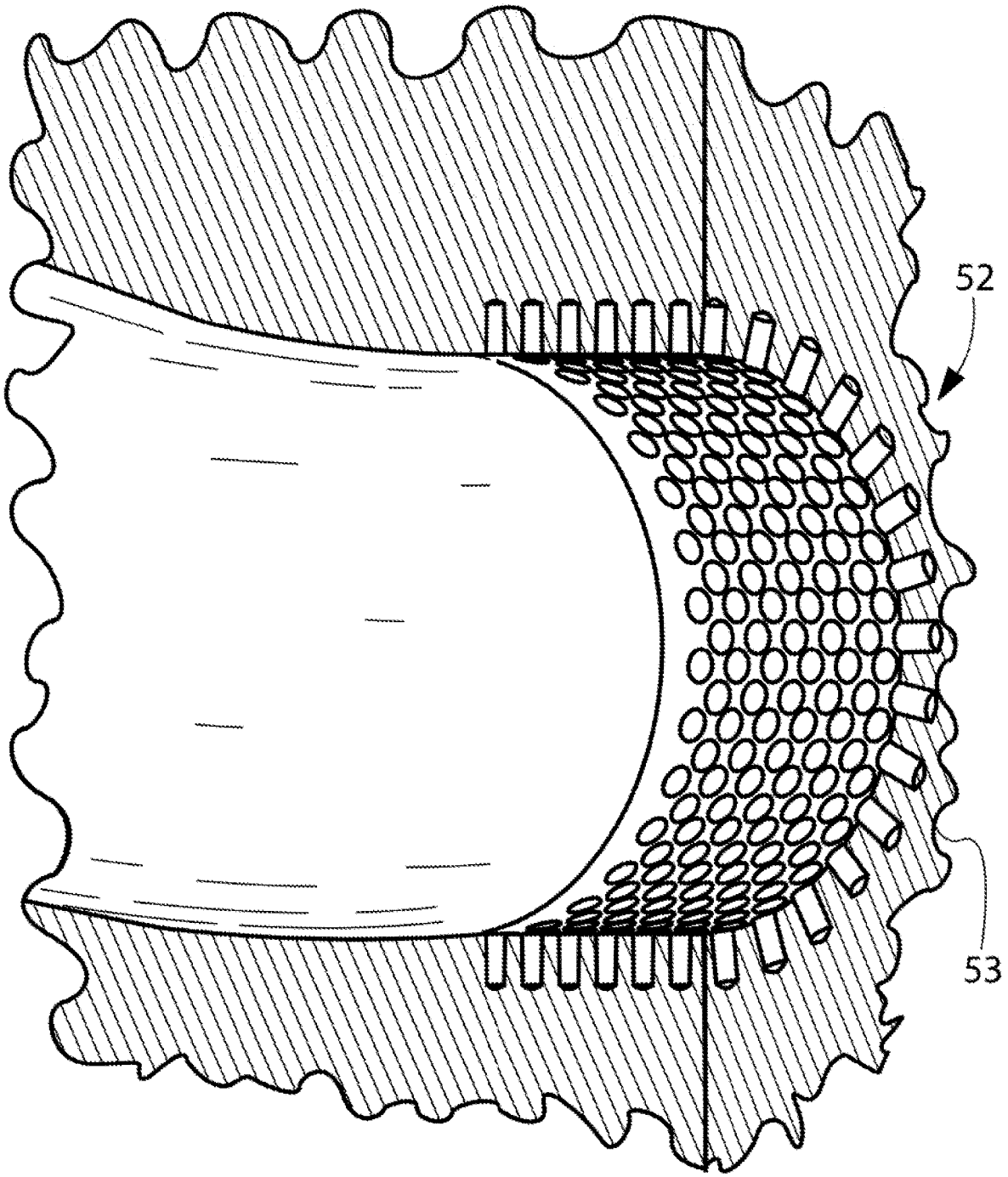
FIG. 3 is a partial cross-sectional and partial pictorial view taken at cut line 3-3 of the tumble area shown in FIG. 2.

FIGS. 2 and 3 illustrate an alternative tumble area 50 that may be used in place of the tumble area shown in FIG. 1. FIG. 3 provides a close up view of the tumble area 50 taken along cut line 3-3 in FIG. 2. The tumble area 50 in FIGS. 2 and 3 includes a non-smooth surface which in this embodiment comprises a field or pattern 52 of pockets 53 and/or grooves provided along the surface of a straight passage. When the compressed air, for example, flows over the pockets 53 in tumble area 50, the pockets may act as Helmholtz resonators. This air movement may create an oscillating pressure wave within each pocket 53 dependent upon the pattern and individual pocket geometry selected as well as the quantifiable qualities and parameters of the air flowing over it. As more air flows across the field 52 of pockets 53, the motions may create a surface boundary layer of conical vortexes which emanate from each pocket with equalization of pressures facilitated by any grooves. These induced vortexes may decrease the available flow diameter of the pocket tumble area 50 and also impart greater tumbling energy to the air at the edges of the passage.

Figure 16:
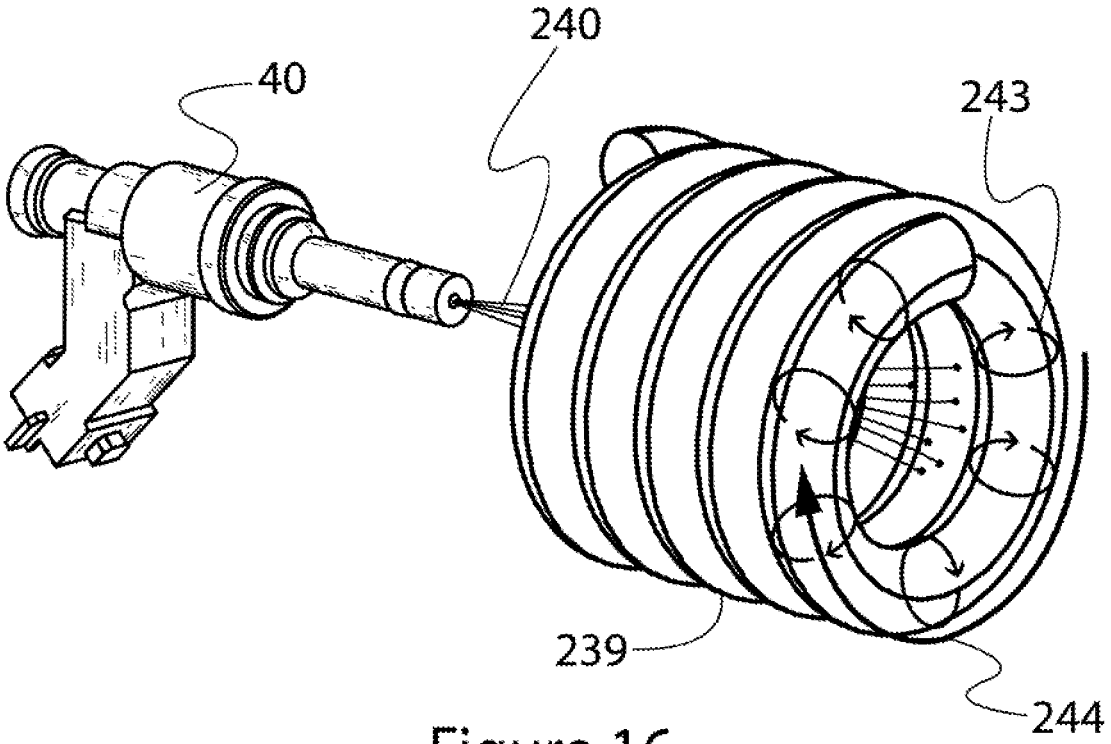
FIG. 16 is a pictorial view of a fuel injector and injected fuel stream bound by a helically rotating toroidal stratified fluid stream in accordance with embodiments of the invention.

As conceptually illustrated in FIG. 16, the tumble area 50 shown in FIGS. 2 and 3 may strengthen both the poloidal flow 243 and the clockwise toroidal flow 244 of the outer stream while inducing another axis of twist to the clockwise toroidal flow 244. This additional axis of twist may result in a helically twisted toroidal ring 239. This may result in increased vorticity while the central stream maintains its mostly linear flow. The extra axis of twist resulting from the tumble area shown in FIGS. 2 and 3 may increase the coherent motion time when flowing out of the exit port 24 of the system shown in FIG. 1. into a combustion chamber, for example. This additional twisting motion may also enhance the swirl, squish, combustion pressure, and/or buffering effects within the combustion chamber.

Figure 4:
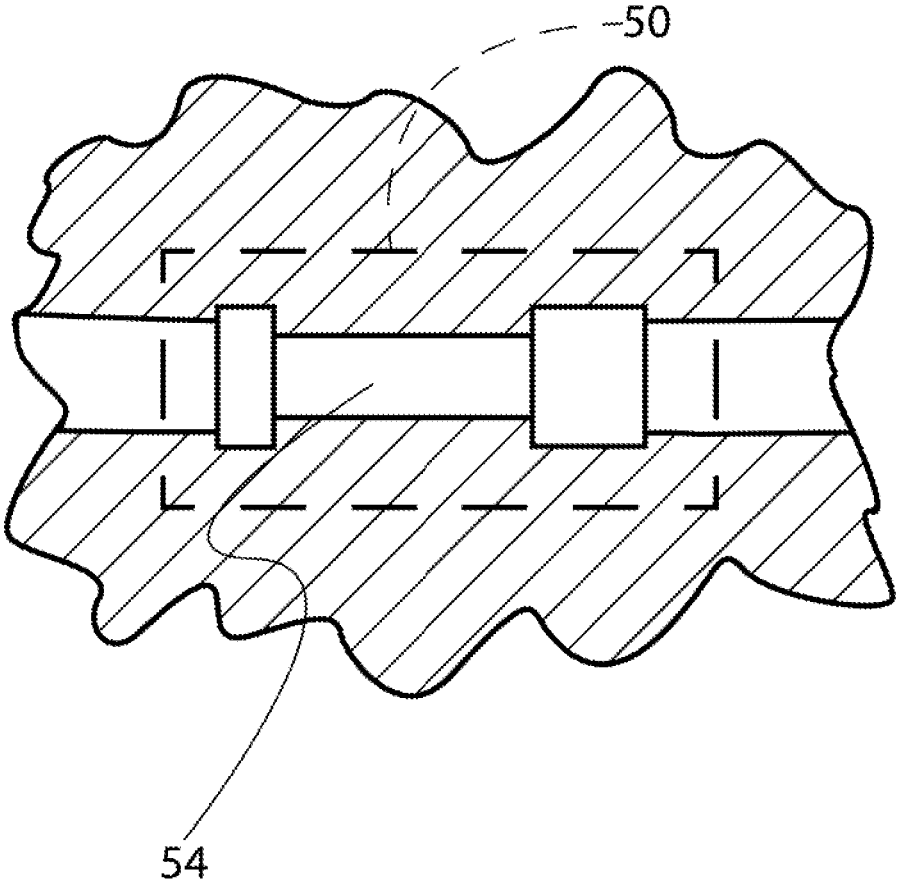
FIG. 4 is a side cross-sectional view of a tumble area constructed in accordance with a third internal combustion engine injection and ignition system embodiment of the present invention.

FIG. 4 illustrates an alternative tumble area 50 that may be used in place of the tumble areas shown in FIGS. 1-3. The tumble area 50 in FIG. 4 includes a stepped straight passage having two or more different diameter sections 54 at two or more longitudinally spaced points along the passage. The different diameter sections 54 may have diameters that are greater than and less than that of the funnel portion 26 (FIG. 1). It is appreciated that in alternative embodiments the side walls of the passage may be patterned. The air flow through the FIG. 4 embodiment may tend to follow an arc at the points where the passage transitions between the varying diameters. This tangential motion may induce swirling low-pressure areas, which induce a tumbling motion in the smallest diameter section of the passage. This may cause a toroidal shaped movement in the outer stream as discussed in connection with the FIG. 1 embodiment. The FIG. 4 embodiment may have densely packed areas of high vorticity in the smallest diameter section 54 of the straight passage. Therefore, the FIG. 4 embodiment may provide performance slightly better than the FIG. 1 embodiment, but lower performance than the FIGS. 2 and 3 embodiment because the areas of high vorticity may not maintain coherence for as long of a time and distance.

Figure 5:
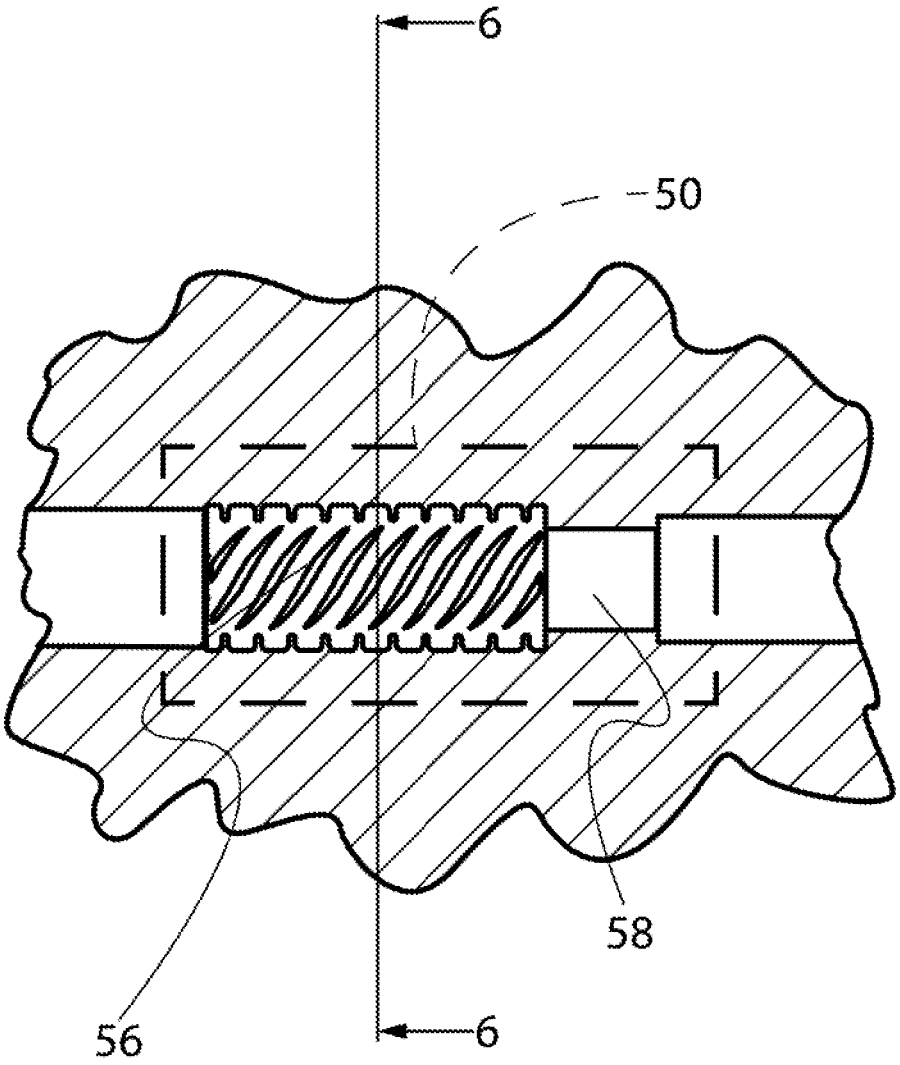
FIG. 5 is a side cross-sectional view of a tumble area constructed in accordance with a fourth internal combustion engine injection and ignition system embodiment of the present invention.
Figure 6:
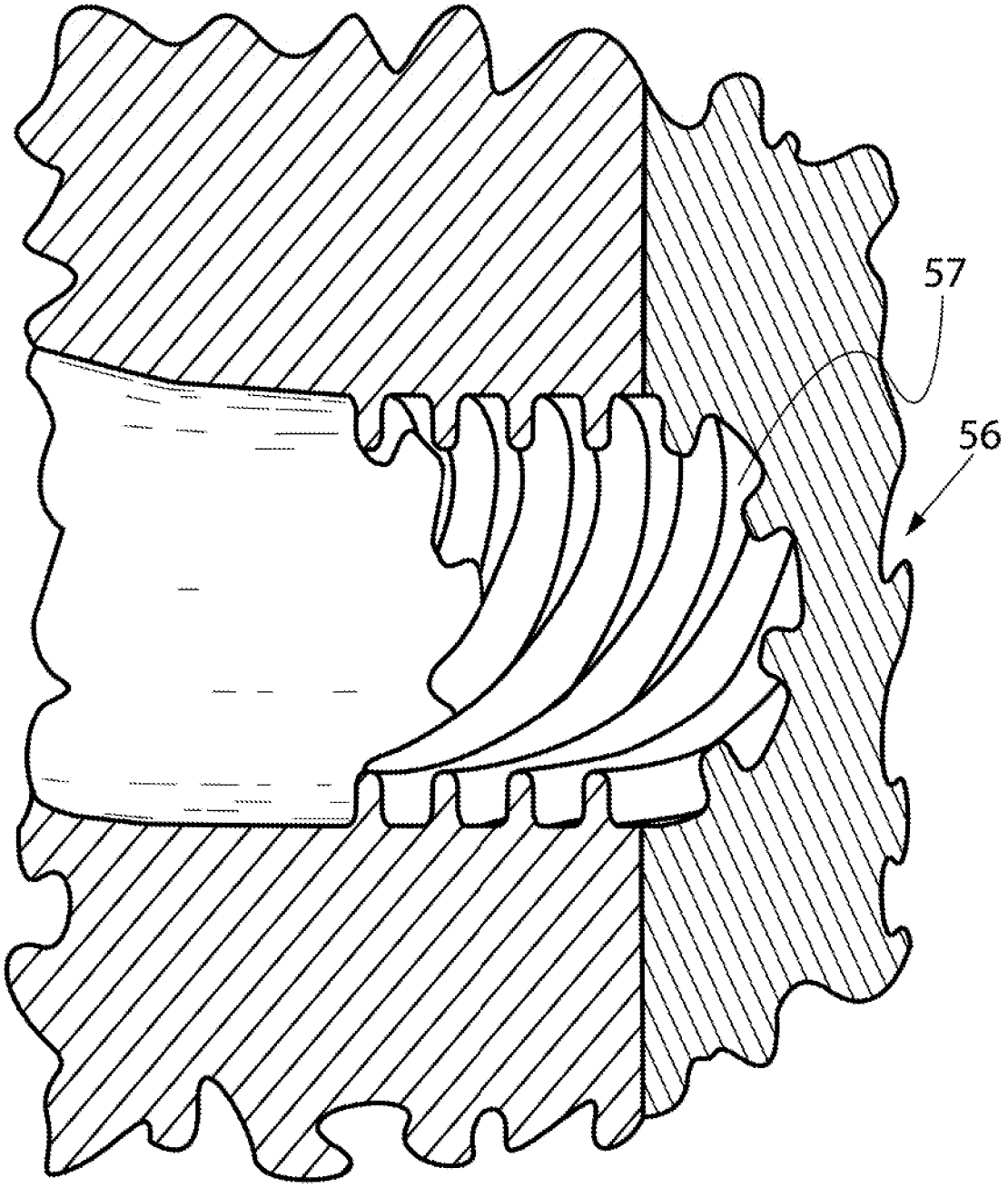
FIG. 6 is a partial cross-sectional and partial pictorial view taken at cut line 6-6 of the tumble area shown in FIG. 5.
Figure 7:
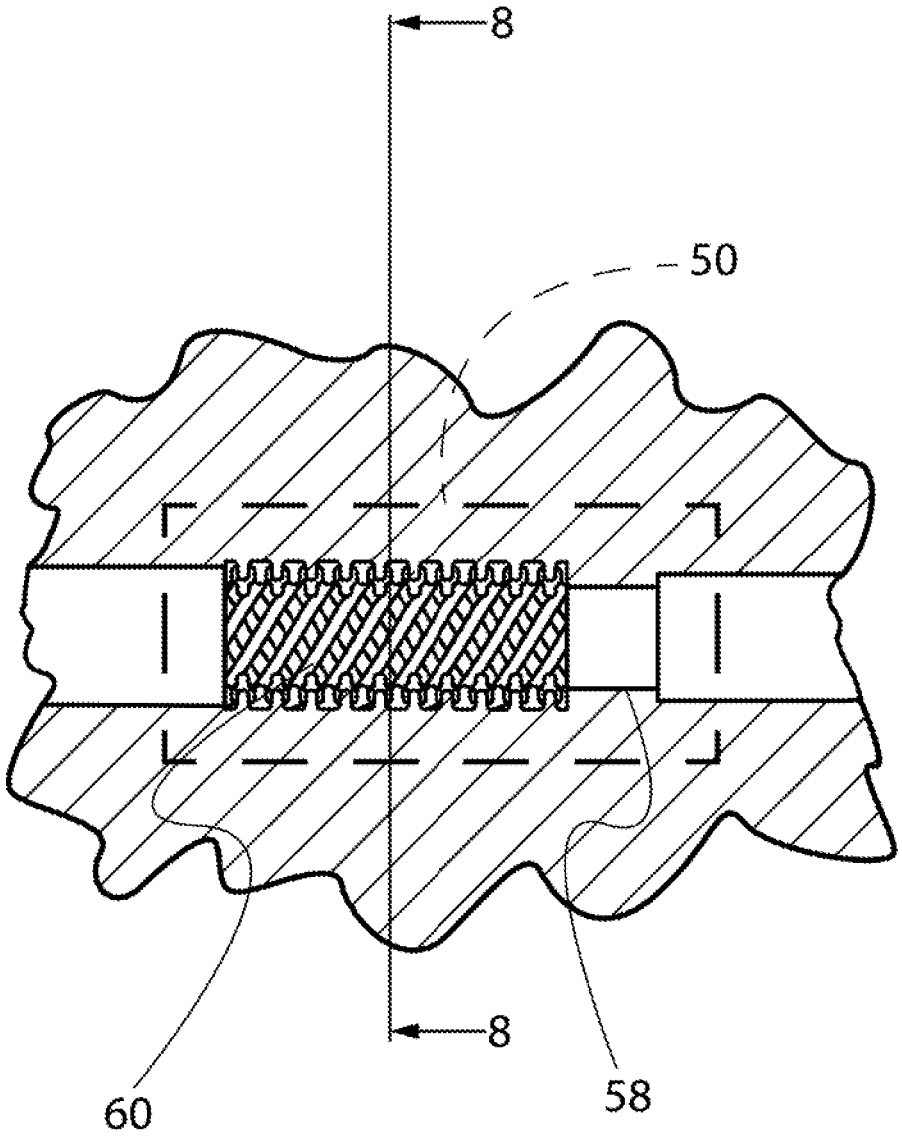
FIG. 7 is a side cross-sectional view of a tumble area constructed in accordance with a fifth internal combustion engine injection and ignition system embodiment of the present invention.
Figure 8:
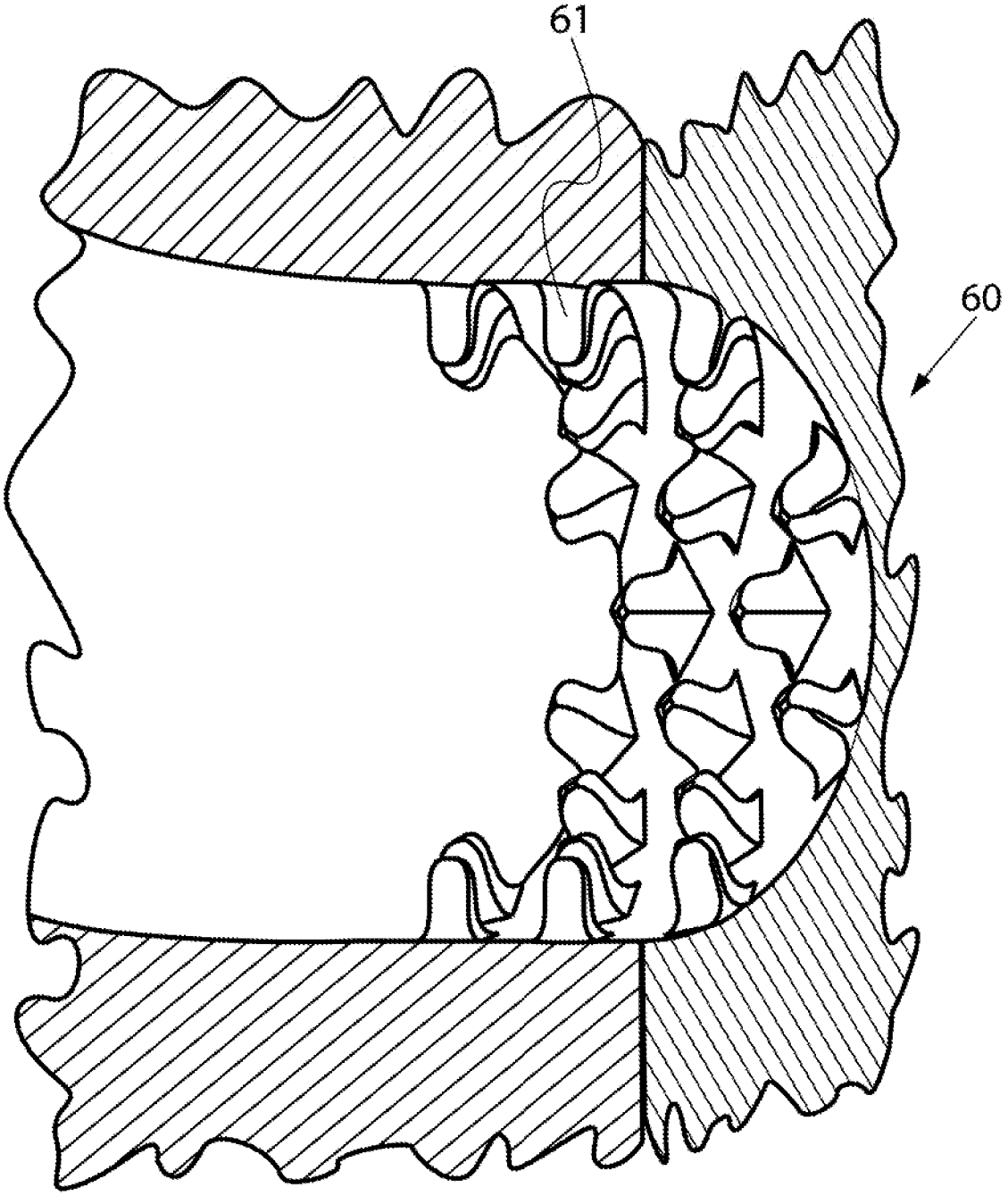
FIG. 8 is a partial cross-sectional and partial pictorial view taken at cut line 8-8 of the tumble area shown in FIG. 7.

FIGS. 5 and 6 illustrate another alternative tumble area 50 that may be used in place of the tumble areas shown in FIGS. 1-4. FIG. 6 provides a close up view of the tumble area 50 taken along cut line 6-6 in FIG. 5. The tumble area 50 in FIGS. 5 and 6 includes a pattern 56 of fins/grooves 57 provided along the surface of a straight passage to create a helical fins tumble area 50 in the main body or block 20 shown in FIG. 1. As shown in FIGS. 5 and 6, the pattern 56 of fins/grooves 57 may be followed by a decreased diameter tumble area 58, which may help to increase the air tumbling effect produced by the helical fins tumble area 50. FIGS. 7 and 8 illustrate another alternative tumble area 50 that may be used in place of the tumble areas shown in FIGS. 1-6. FIG. 8 provides a close up view of the tumble area 50 taken along cut line 8-8 in FIG. 7. The tumble area 50 in FIGS. 7 and 8 includes a pattern of fins/grooves provided at the surface of the straight passage to provide a pattern 60 of helically staggered fin islands 61 within the tumble area 50 in the main body or block 20 shown in FIG. 1. With regard to the embodiments shown in FIGS. 5-8, when the air traverses the fins/grooves, they may impart a tumbling helical motion with a greater energy imparted to the helical motion than to the tumbling motion. This air movement may create a surface boundary layer with twisting and rolling air dependent upon the implemented pattern/geometry and the parameters of the air provided at the input port 22 of the system shown in FIG. 1. As more air traverses the boundary layer, it may create a surface boundary layer that imparts greater tumbling energy to the air at the edges of the passage. This tumbling and twisting air may then traverse the decreased diameter tumble area 58.

With renewed reference to FIG. 16, both the poloidal flow 243 and clockwise toroidal flow 244 of the FIGS. 5-6 embodiment and the FIGS. 7 and 8 embodiment may be strengthened as compared with the FIG. 1 embodiment while inducing another axis of twist to the clockwise toroidal flow 244 which may result in a helically twisted toroidal ring 239. When either of the FIG. 5-6 or 7-8 embodiments are used, the extra axis of twist may increase coherent motion time, and thus distance, of the air flow out of the exit passage 24 into the combustion chamber. This additional twisting motion may enhance swirl and squish within the combustion chamber. This embodiment may be more costly to produce and also create a higher back pressure with a significant reverse fuel flow into the funnel portion 26. This reverse fuel flow may tend to mix with the incoming air, adding fuel to both the inner and outer stream areas. This may be advantageous in some applications, as the fuel in the outer stream may tend not to burn until the coherent motion is sufficiently decreased. This may create a double burn effect, where the inner stream burns and then later ignites the outer stream with a time delay.

Figure 9:
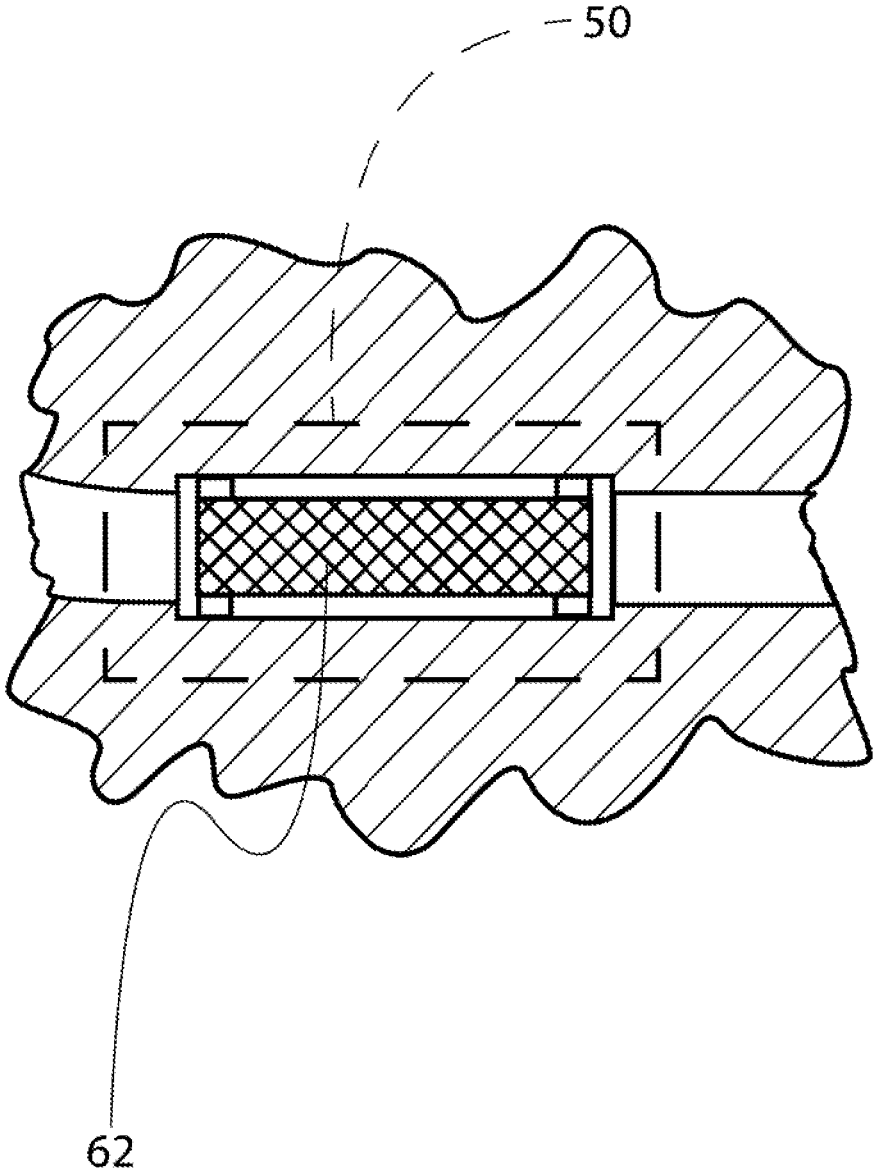
FIG. 9 is a side cross-sectional view of a tumble area constructed in accordance with a sixth internal combustion engine injection and ignition system embodiment of the present invention.
Figure 10:
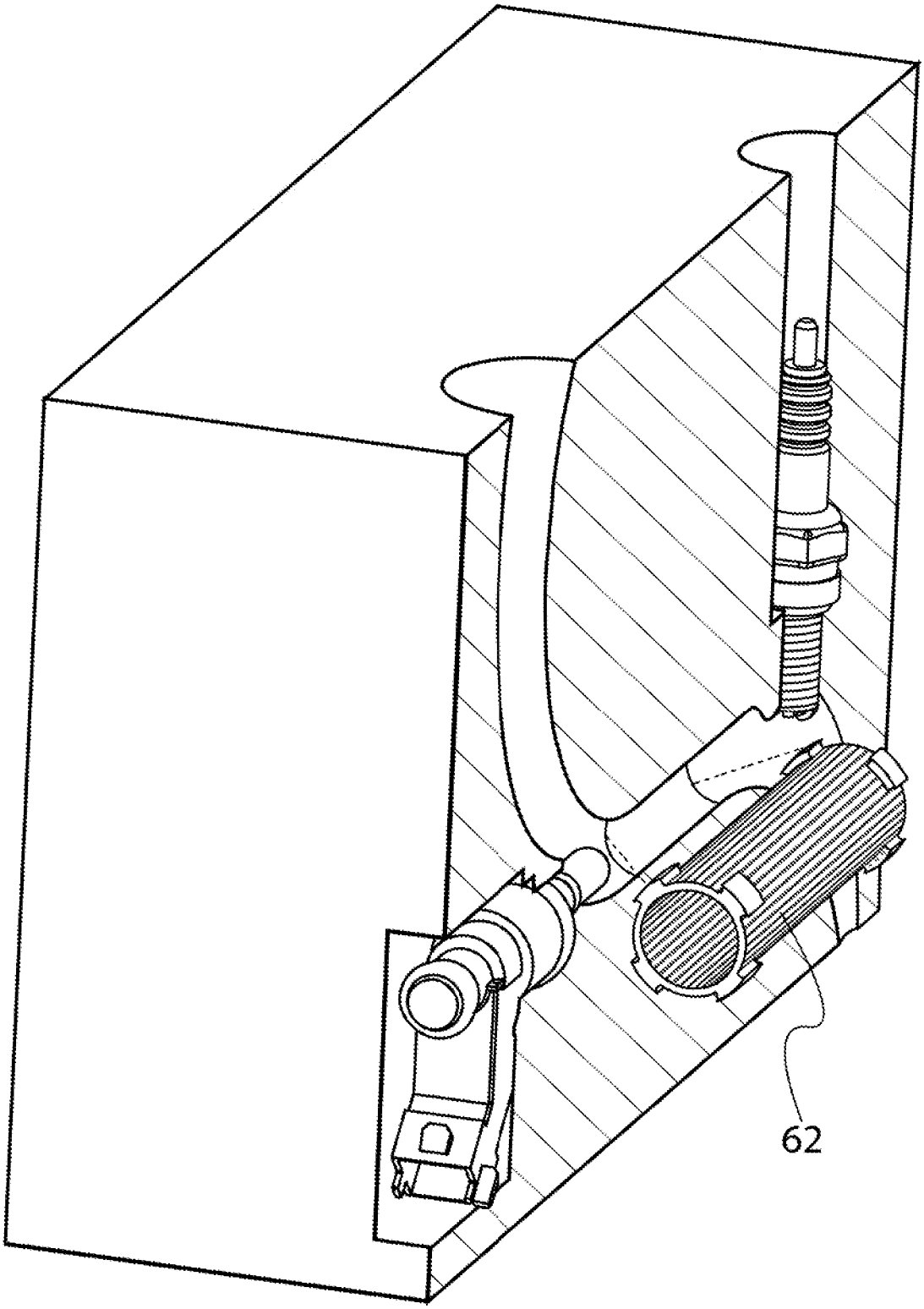
FIG. 10 is an exploded partial cross-sectional and partial pictorial view of the embodiment shown in FIG. 9.

FIGS. 9 and 10 illustrate another alternative tumble area 50 that may be used in place of the tumble areas shown in FIGS. 1-8. FIG. 10 provides a pictorial view of the tumble area 50 shown in FIG. 9 installed in a system of the type shown in FIG. 1. The tumble area 50 in FIGS. 9 and 10 includes a wire mesh tube or a perforated thin-wall tube 62 mounted in stand-off rings affixed around the outside of the tube. This tube 62 with stand-off rings may be disposed within a straight passage and is preferably affixed in the straight passage using suitable means to provide a suspended tube 62 tumble area 50. The stand-off rings may have recesses which allow compressed air to flow between the straight passage and the tube 62. This may allow the air to flow freely over both sides of the tube 62, which may create the suspended tube tumble area 50. When the air traverses both sides of the tube 62, the two streams of air may flow over each other at different velocities. This may create tumbling areas of lower pressure within the openings of the tube 62. These tumbling pockets of low pressure may impart a tumbling motion to the air near the tube 62 surface. With reference to FIG. 15, this may strengthen both the poloidal flow 243 and clockwise toroidal flow 244 which results in the formation of a vortex ring 238. An increased boundary layer thickness and surface vorticity may result. The FIGS. 9 and 10 embodiment may also create a decreased center diameter of smooth flow stream lines. The increased boundary layer thickness may directly affect the radius of the poloidal flow 243 and therefore increase the centrifugal force. The increased outer stream layer thickness may increase coherent motion time when flowing out the exit passage 24 (FIG. 1) into the combustion chamber. This may also significantly enhance swirl, squish, combustion pressure, and buffering effects within the combustion chamber while being very cost effective to produce and service.

Figure 11:
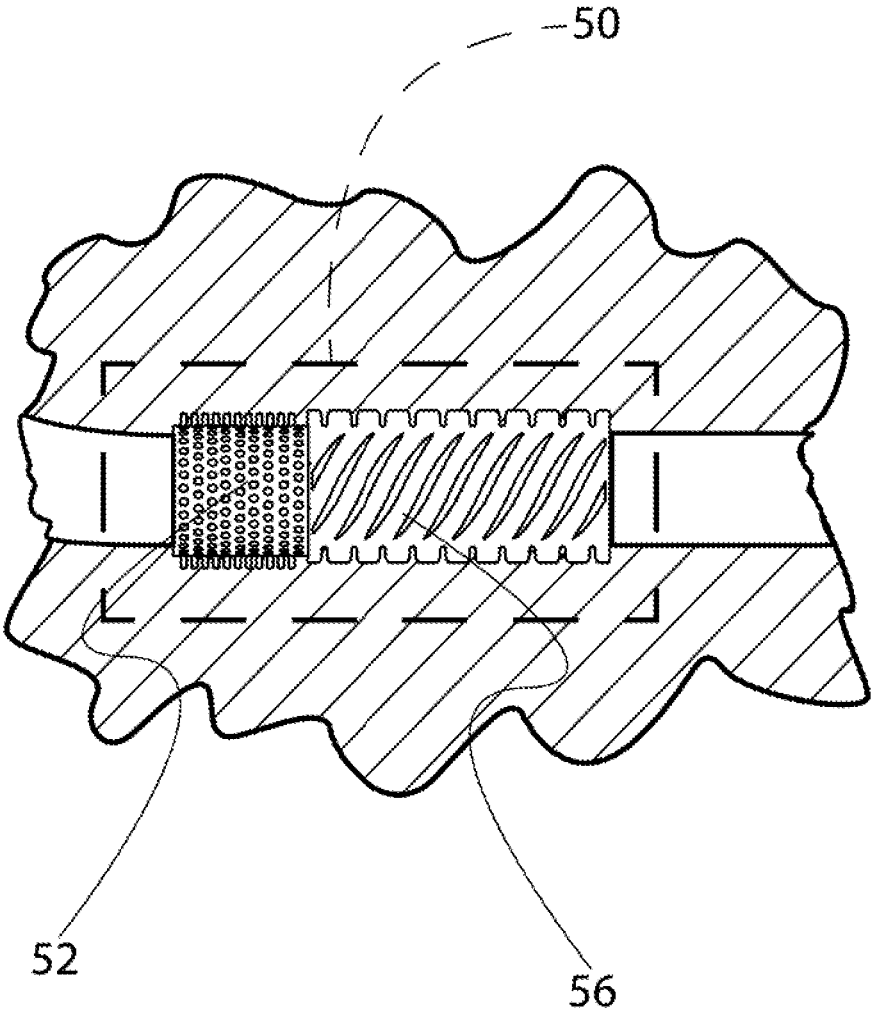
FIG. 11 is a side cross-sectional view of a tumble area constructed in accordance with a seventh internal combustion engine injection and ignition system embodiment of the present invention.

FIG. 11 illustrates an alternative tumble area 50 that may be used in place of the tumble areas shown in FIGS. 1-10. The tumble area 50 in FIG. 11 includes a patterned pocket tumble area 52 and helical fins tumble area 56 of the types shown in FIGS. 2 and 5, respectively, combined in series, preferably directly adjacent to each other, but not necessarily so. With reference to FIG. 15, the FIG. 11 embodiment may increase the clockwise toroidal flow 244 which may cause a comparable surface layer of vorticity, but with a significantly longer length. This may provide a flow through the large diameter center stream similar to that produced by the FIG. 2 embodiment. However, the motion coherence time of the stream within the combustion chamber may be significantly increased compared with either the FIG. 2 or FIG. 5 embodiments. This may enhances swirl, squish, combustion pressure, and buffering effects within the combustion chamber and possibly extend the buffering effect into the exhaust cycle. This may be useful for high RPM engine implementations using a turbocharger, as it may buffer the impeller surface from the increased heat while allowing it to efficiently utilize these increased forces.

Figure 12:
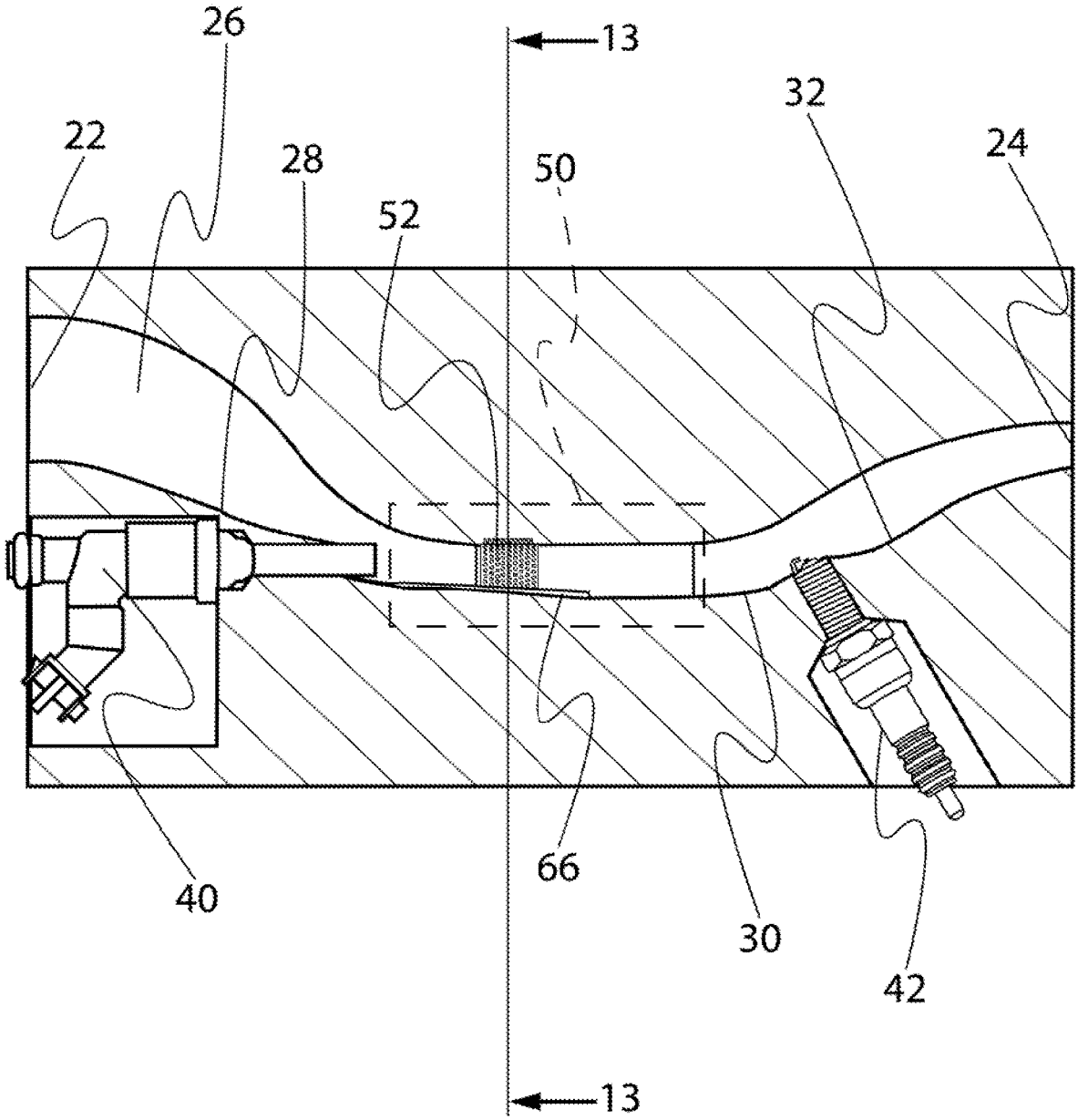
FIG. 12 is a side cross-sectional view of a tumble area constructed in accordance with an eighth internal combustion engine injection and ignition system embodiment of the present invention.

With reference to FIGS. 2 and 12, it is appreciated that the FIG. 2 tumble area 50 could be used in a more compact, less curved passage system as shown, for example, in FIG. 12. Such a modified embodiment may allow the outer stream coherence to last longer (i.e., extend further) as less coherent motion energy is wasted by traveling along a steep curve over a greater total distance. This may increase the coherent motion time of the stream within the combustion chamber, as it tends to arrive faster while retaining more coherent motion energy. The straighter more compact embodiment may also allow it to be retrofitted to more engine applications with less design effort. An adapter would allow the exit passage 24 to connect with the combustion chamber through the original sparkplug location. Any retrofit application would still require a computer control module to control/modify injector timing and ignition timing, which may differ slightly from the engine's native timing and sequence. This could be accomplished with a piggy-back style module or with an entire computer control module upgrade/replacement.

In still another modification of the FIGS. 2 and 12 embodiment, the air input 22 and the exit passage 24 may be nearly in line with one another. In such an embodiment, the sparkplug 42 extends upward into the passage from below and is set at an angle relative to the longitudinal axis of the patterned pocket tumble area 52. The sparkplug ramp 30 may also be modified and the expansion area 32 may be provided on the opposite side of the passage. The relocation of the expansion area 32 may reduce some of the turbulence induced by the sparkplug 42 in the stream. The reduced turbulence may allow the outer stream coherence to last longer as less coherent motion energy is wasted. This may increase the coherent motion time of the stream within the combustion chamber, as it tends to retain more coherent motion energy. This embodiment, like the previous embodiment, may allow it to be retrofitted to many engines using an appropriate means of computer control and an adapter between the exit passage 24 and the original sparkplug location of the combustion chamber.

With reference to the immediately foregoing embodiment and the FIG. 11 embodiment, the two may be combined to provide stratified stream generation using the patterned pocket tumble area 52 followed by the helical fins tumble area 54 in a system having a compressed air input 22 and an exit passage 24 substantially in line with one another. The elongated axis of the fuel injector 40 and/or the sparkplug 42 may be set at a non-right (i.e., acute or oblique) angle relative to the surrounding wall to further reduce undesirable turbulence and increase the serviceability of the component locations. In such an embodiment, the angles of attack of the integrated injector ramp 28 and the sparkplug ramp 30 angles may be varied as compared with the FIG. 11 embodiment. The expansion area 32 may be positioned opposite of the sparkplug 42, which may reduce undesirable turbulence induced by the fuel injector 40 and the sparkplug 42 in the stream. The reduced turbulence may allow the outer stream coherence to last longer as it encounters less unproductive turbulence along the path to the combustion chamber. This may increase coherent motion time of the stream within the combustion chamber. This embodiment may be the most space efficient and easiest to execute in retrofit implementations and may significantly improve engine efficiency while decreasing emissions with proper tuning. A separate add-on computer control module may be utilized to control the new additional engine hardware; however, it may be more efficient and flexible to use a new computer control module to control all of the engine and power-train functions instead of having two computers controlling the separate functions.

It is appreciated that one or more of the foregoing described embodiments may be retrofit to existing engines including poppet valves disposed between an engine cylinder and the ignition system of the types shown in FIGS. 1 and 12. In such a retrofit, both the intake and exhaust valves may remain unmodified and continue to be utilized. The stratified stream systems shown in FIGS. 1 and 12, for example, may be fitted to the engine's head where a sparkplug would traditionally be attached between the two overhead cams, appropriate valve trains, and covers. This allows the ignited stratified stream system to connect to the center of the chamber and provide expansion and tumbling along the head of the chamber. The expansion may urge the outer stream against the chamber walls, which allows the coherent motion to buffer the inner stream from the chamber walls to increase pressure and thermal efficiency. This also may help to isolate the burning charge from the combustion chamber walls, which may prevent flame front quenching from pressure wave echoes and chamber wall heat sinking. This buffering also may tend to block crevices in the chamber such as around the head gasket area and above the piston rings, which may prevent fuel and other materials from accumulating in these areas. This may reduce hydrocarbon emissions from the combustion process, prevent oil film erosion/washing/contamination, and reduce/prevent oil mists in exhaust gases which may diminish carbon buildup, improve sensor lifespan, and increase catalyst lifespan. The buffering action may reduce the heat transferred from the burning charge to the cooling system enveloping the combustion chamber walls, which may increase thermal efficiency of the cycle. The motion and pressure from the outer stream may force the inner stream to make more intimate and continuous contact within itself. This motion and pressure also may increase the burn rate by inducing molecular contact turbulence and decrease peak temperatures by preventing hot spots within the burning charge.

Figure 13:
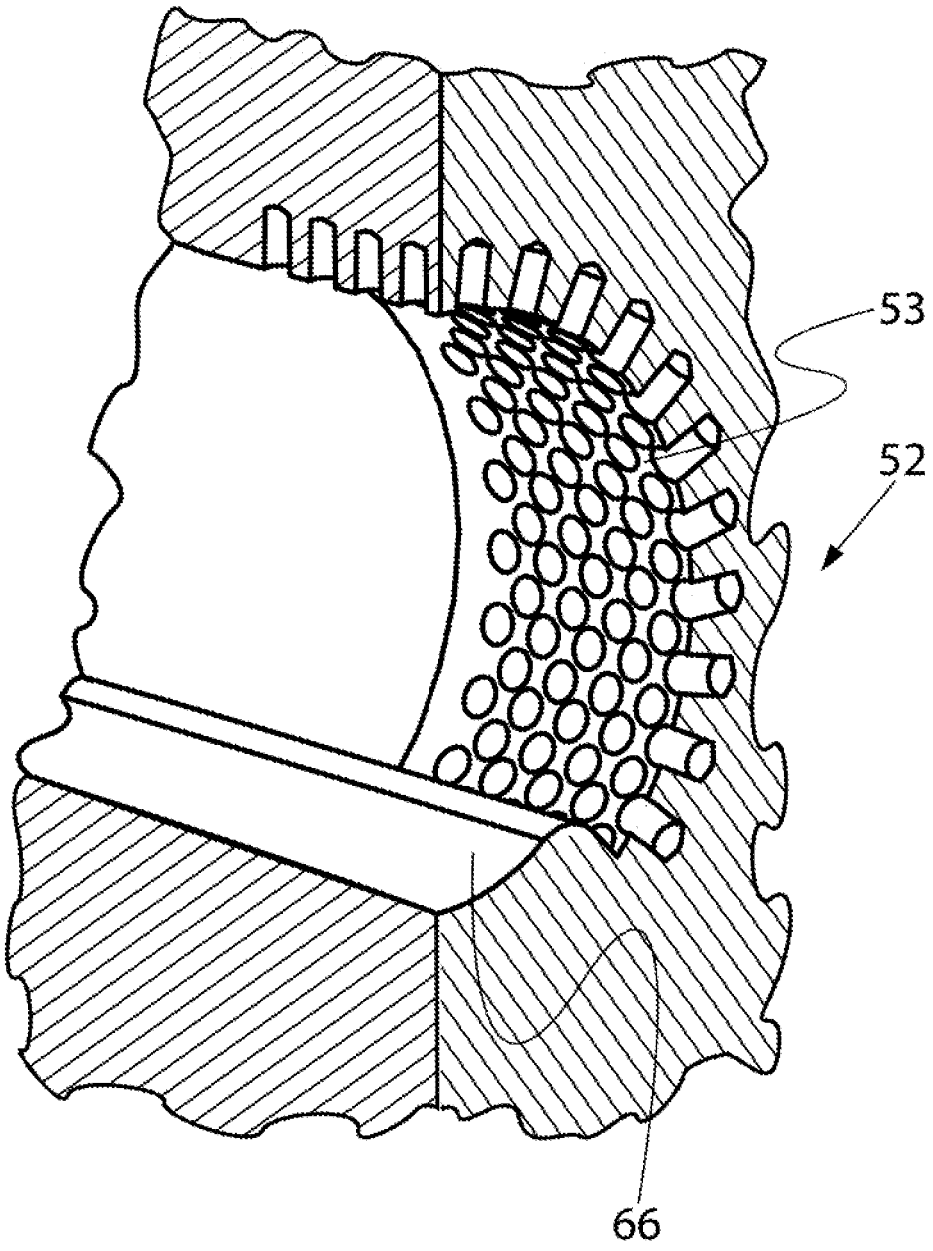
FIG. 13 is a partial cross-sectional and partial pictorial view taken at cut line 13-13 of the tumble area shown in FIG. 12.
Figure 17:
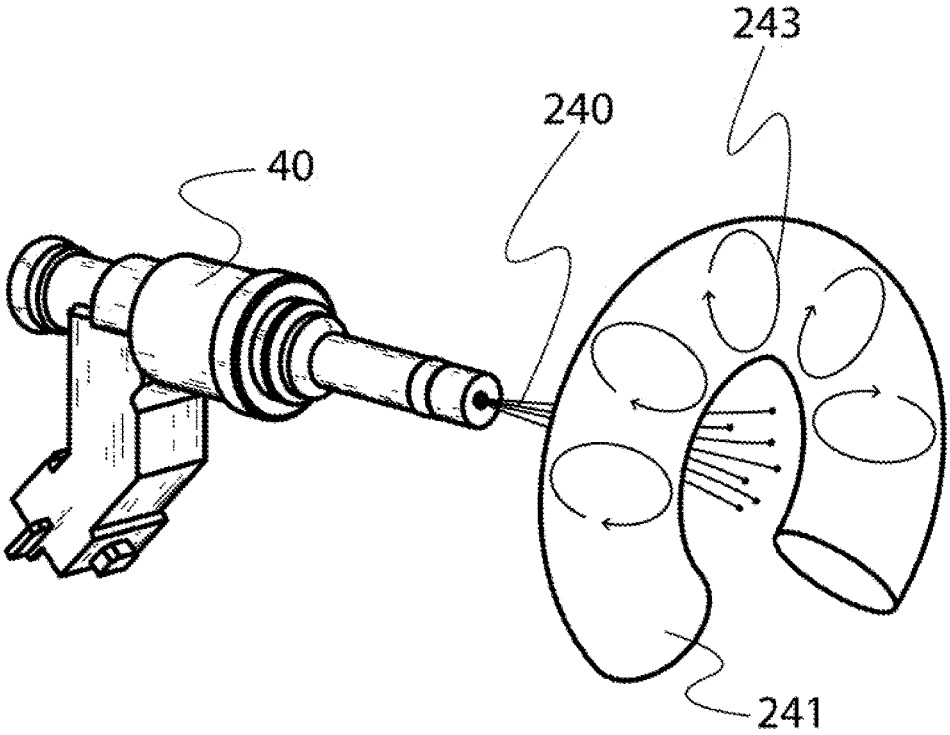
FIG. 17 is a pictorial view of a fuel injector and injected fuel stream bound by a cut rotating toroidal stratified fluid stream in accordance with embodiments of the invention.

With reference to FIGS. 12 and 13, another alternate embodiment to that described in connection with FIGS. 1-11 is illustrated. FIG. 13 provides a close up view of the tumble area 50 taken along cut line 13-13 in FIG. 12. The FIGS. 12 and 13 embodiment may operate in like manner to the FIGS. 1-11 embodiments, except as noted below. In the FIGS. 12 and 13 embodiment, air may be provided to the system at an ambient or boost pressure at the input port 22. The air flows from the input port 22 into the funnel portion 26 which may include an integrated injector ramp 28 to reduce transitional air flow turbulence over the exposed nozzle of a fuel injector 40. The funnel portion 26 may transition to or lead to a tumble area 50. The tumble area 50 may have a non-circular, slightly U-shaped cross-section resulting from a bulged wall portion or fuel ramp 66 that extends from a point near the injector 40 past a patterned pockets portion 52 towards the sparkplug 42. The portion of the tumble area 50 that is unpopulated with a pattern of pockets may extend along the side between the fuel injector 40 and the sparkplug 42. The fuel ramp 66 may tend to prevent toroidal flow, which makes the generated outer stream resemble a U-cut vortex ring 241 with just poloidal flow 243 surrounding the fuel stream 240 injected by the injector 40 as conceptually illustrated in FIG. 17. The central stream has a fuel stream 240 added by the fuel injector 40 for most engine applications. This may make the central stream resemble an oval or egg shape when the stratified stream enters the combustion chamber. This may create a smoother flow area with a small amount of tumble induced by the sparkplug. This may allow the central stream to be externally accessible for additional fuel injection within the combustion chamber. The lower amount of vorticity may be observed along the bottom wall of the passage after the sparkplug 42. This may allow further fuel to be added via a direct injector in the combustion chamber and may also be more compatible with supplemental port injection if the externally accessible inner stream side is oriented towards the intake valve or injector in the combustion chamber. However, this benefit may come at the expense of losing some circumferential area of buffering benefits, so it may generate a hotter area which is exposed to the cooling system. This may also create a hot spot in the chamber walls and/or piston skirt, which could cause uneven metal expansion or even pre-ignition conditions if the engine is not designed properly to account for this uneven heat load stripe. It may also allow a greater quantity of fuel to accumulate in crevasses, which may lead to some amount of hydrocarbon emissions in the exhaust. This challenge may be overcome by using piston and head designs configured to agitate the crevasse areas along the striped zone.

Figure 18:
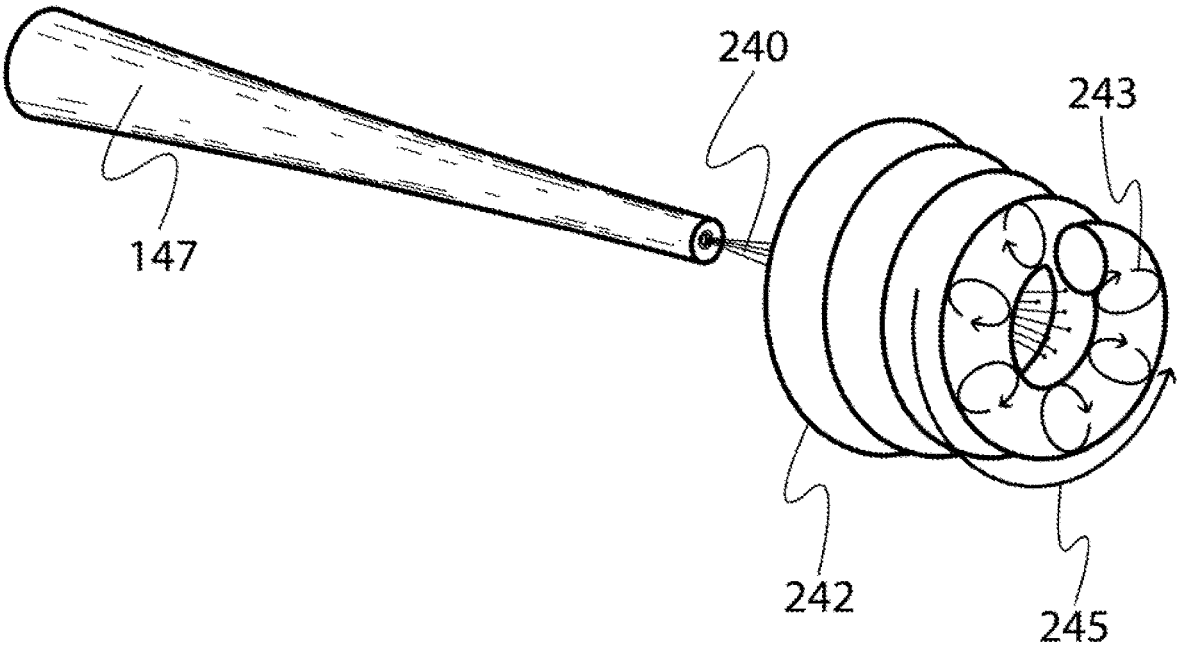
FIG. 18 is a pictorial view of a fuel injector and injected fuel stream bound by a helically rotating toroidal stratified fluid stream with a frusto-conical shape in accordance with embodiments of the invention.
Figure 19:
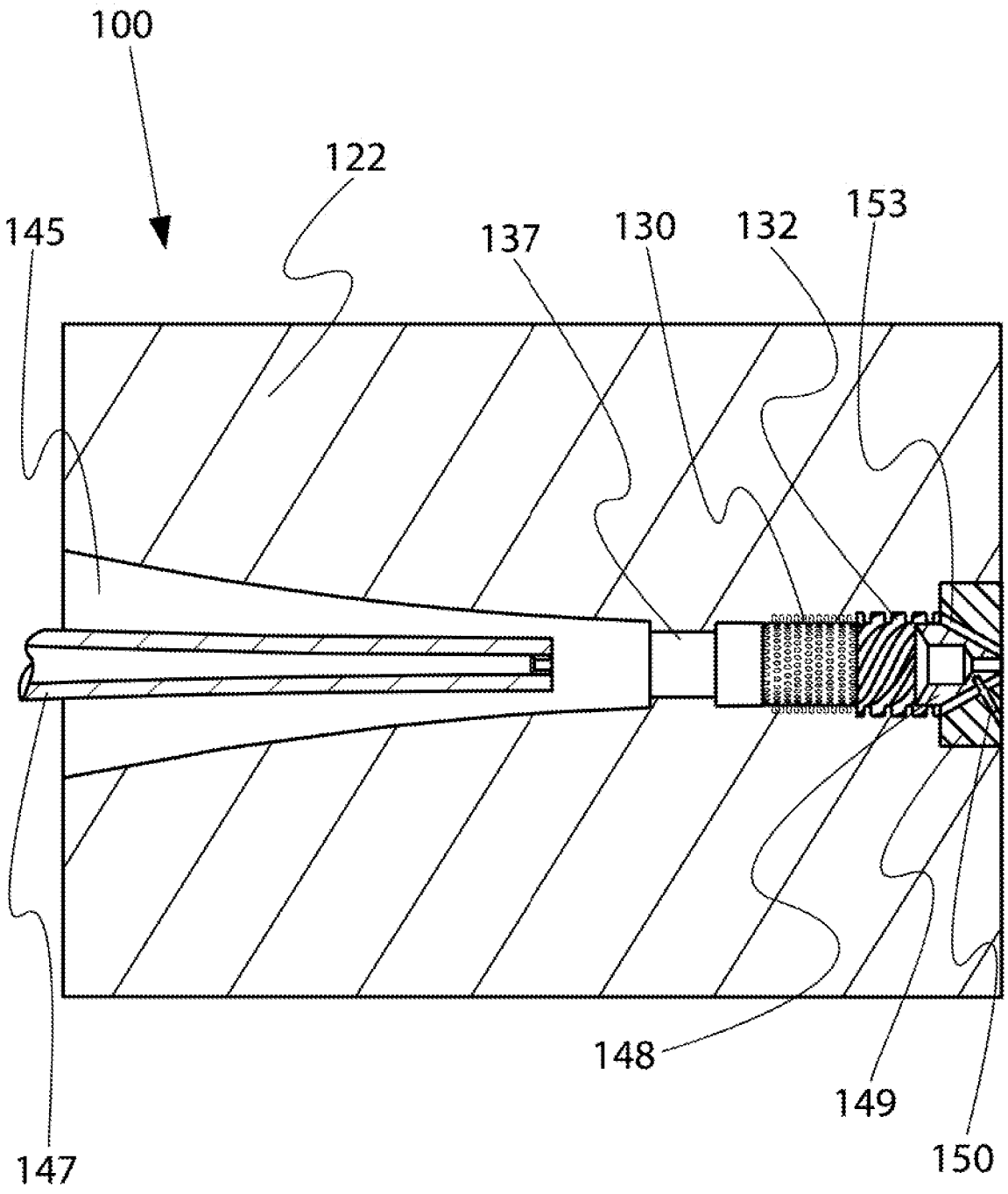
FIG. 19 is a side cross-sectional view of a tenth stratified stream injection and turbulence system embodiment of the present invention.
Figure 20:
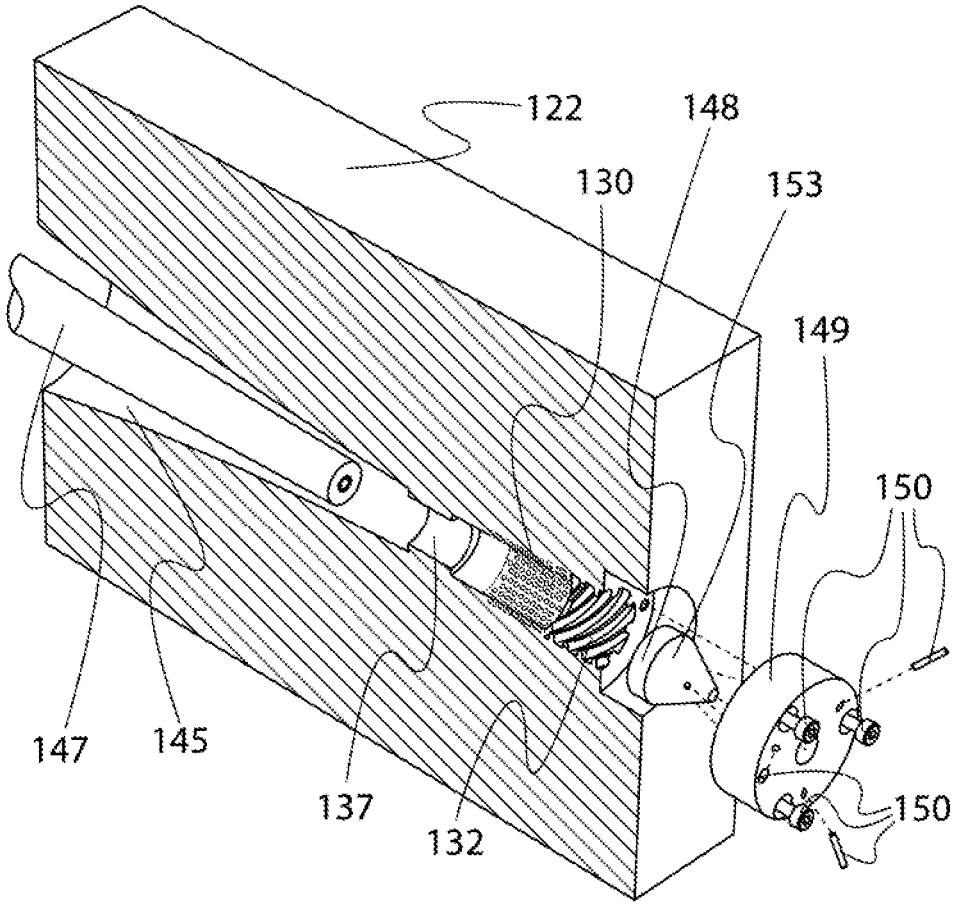
FIG. 20 is an exploded partial cross-sectional and partial pictorial view of the embodiment shown in FIG. 19.

With reference to FIGS. 18-26, various double-layer nozzle based stratified stream system embodiments are illustrated. With reference to FIGS. 19 and 20, an alternative internal combustion engine injection and ignition system embodiment 100 is shown formed in a main body 122. The main body 122 may be part of a cylinder head, an engine block, and/or other engine component, for example. The main body 122 may define a space, such as a continuous fluid passage, chamber or channel, extending from an input port through a funnel portion 145 to a tumble area. The fluid passage may be generally cylindrical as viewed in cross-section taken along its longitudinal axis over a majority of its length. Some interruptions in the generally cylindrical cross-sectional shape of the fluid passage may be present. The tumble area may include, in sequential order, a decreased diameter tumble area 137, a patterned pocket tumble area 130, a helical fins tumble area 132, and a pirouette area 153 formed by the space between the outside surface of the inner nozzle 148 and the inside surface of the outer nozzle 149. The decreased diameter tumble area 137 may be defined by a shoulder extending inward from the junction of the funnel portion and the tumble area. A fastener 150, such as press-fit elements, welds, adhesives, pins, screws, threads, and the like, may be used to affix the inner nozzle 148 to the outer nozzle 149 and the outer nozzle 149 to the main body 122. A short injection nozzle 147 may be generally centrally located within the input port 145. The tip of the short injection nozzle 147 may be spaced from the decreased diameter tumble area 137. Fuel, or in other embodiments other liquid or fluid, may be supplied to system 100 via the short injection nozzle 147.

The decreased diameter tumble area 137 may cause the flow from the portion of the input port 145 surrounding the short injection nozzle 147 to first constrict and then arc outward towards the wall. This may urge the outer edges of the stream along an arc into the patterned pocket tumble area 130, which may induce a strong tumbling action. This action may be carried into the next section of the helical fins tumble area 132, which may be formed counter-clockwise in this implementation to more efficiently enhance and reinforce the motion created by patterned pocket tumble area 130. The resulting toroidal flow may continue into the pirouette area 153 for injection into a combustion chamber, for example.

The pirouette area 153 is a truncated decreasing diameter conical area, which may force the toroidal flow to move at a defined angle towards the center of the flow stream. This may continually decrease the toroidal main body foci diameter of the outer flow stream, which may increase the angular flow speed along an additional angular vector. This vorticity may continue slightly past the tip of the nozzle, and constrict the central stream flow past the physical tip of the nozzle, forcing the central stream flow to refocus without using a physical structure at the location. The pirouette area 153 may focus the stream tighter for a longer distance past the physical nozzle tip, as is conceptually illustrated in FIG. 18.

With reference to FIG. 18, the counter-clockwise threads may increase the cooperative reinforcement between the poloidal flow 243 and the counter-clockwise toroidal flow 245. This may induce an extremely strong counter-clockwise toroidal flow 245, which may create a helically twisted conical-shaped vortex ring 242. The conical-shaped cortex ring 242 may refocus the central stream beyond the physical tip of the nozzle. For engine applications, the central stream area typically contains a fuel stream 240 added by the short injection nozzle 147.

Figure 25:
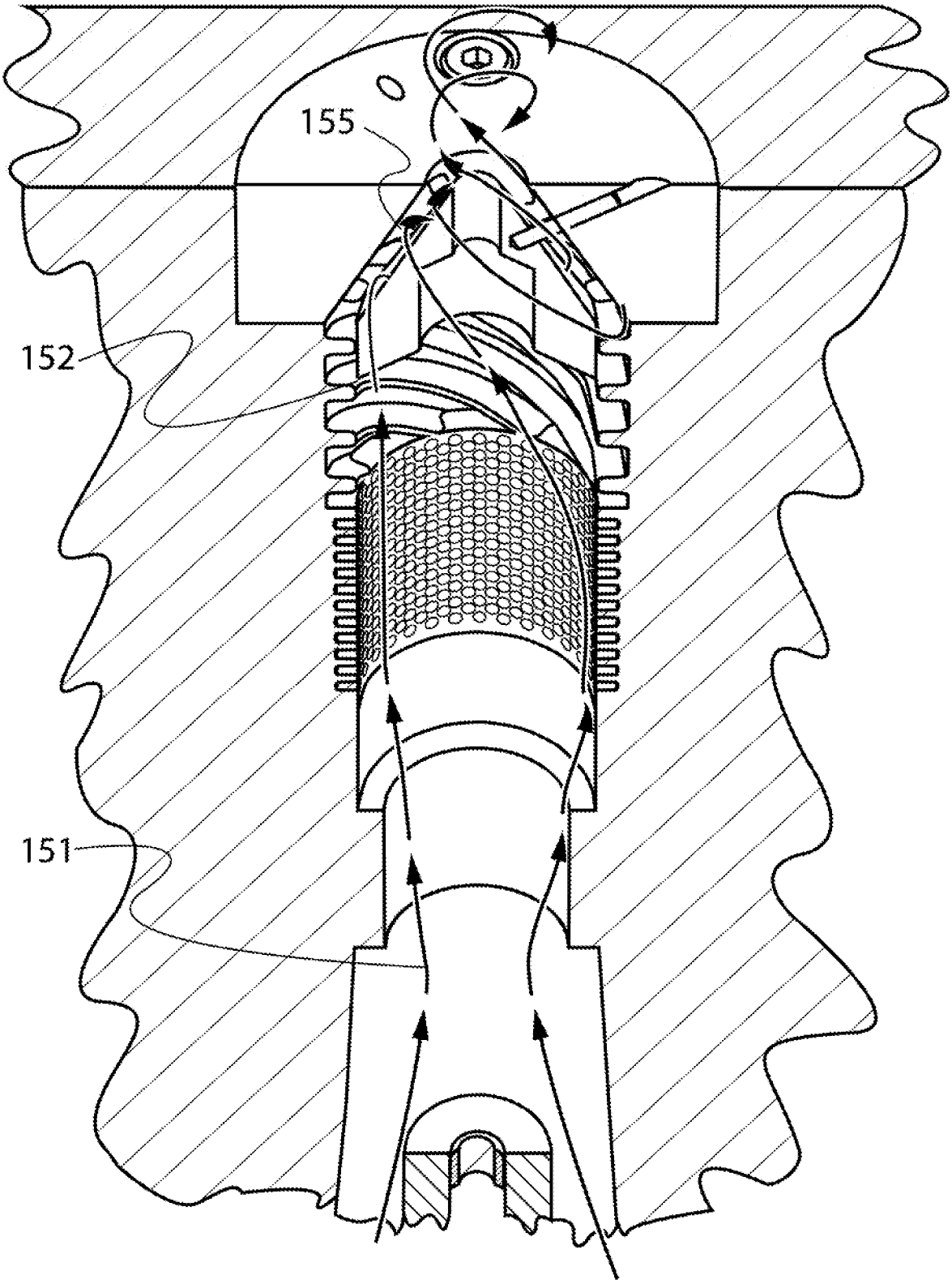
FIG. 25 is a partial cross-sectional and partial pictorial view of the embodiment shown in FIGS. 23-24 showing a predicted outer area flow path.

An expected flow pattern for the outer stream is illustrated in more detail in FIG. 25. After the main flow for the outer stream progresses over the injection nozzle, the flow may be constricted in the neckdown area 151. This may guide the outer stream flow in upon itself in an arc and compresses it. The outer stream flow may then decompress and arc into the turbulence and spin area 152, which may cause the outer stream flow to tumble over itself and then spin helically along the passage. The outer stream flow then may be separated by the layered passages of the nozzle and enter the pirouette area 155. The pirouette area 155 may have a truncated cone shape which continually decreases the diameter of the outer stream and guides it towards the center stream at an angle thereby inducing a smaller radius of motion, which may increase the intensity of the motion.

Figure 26:
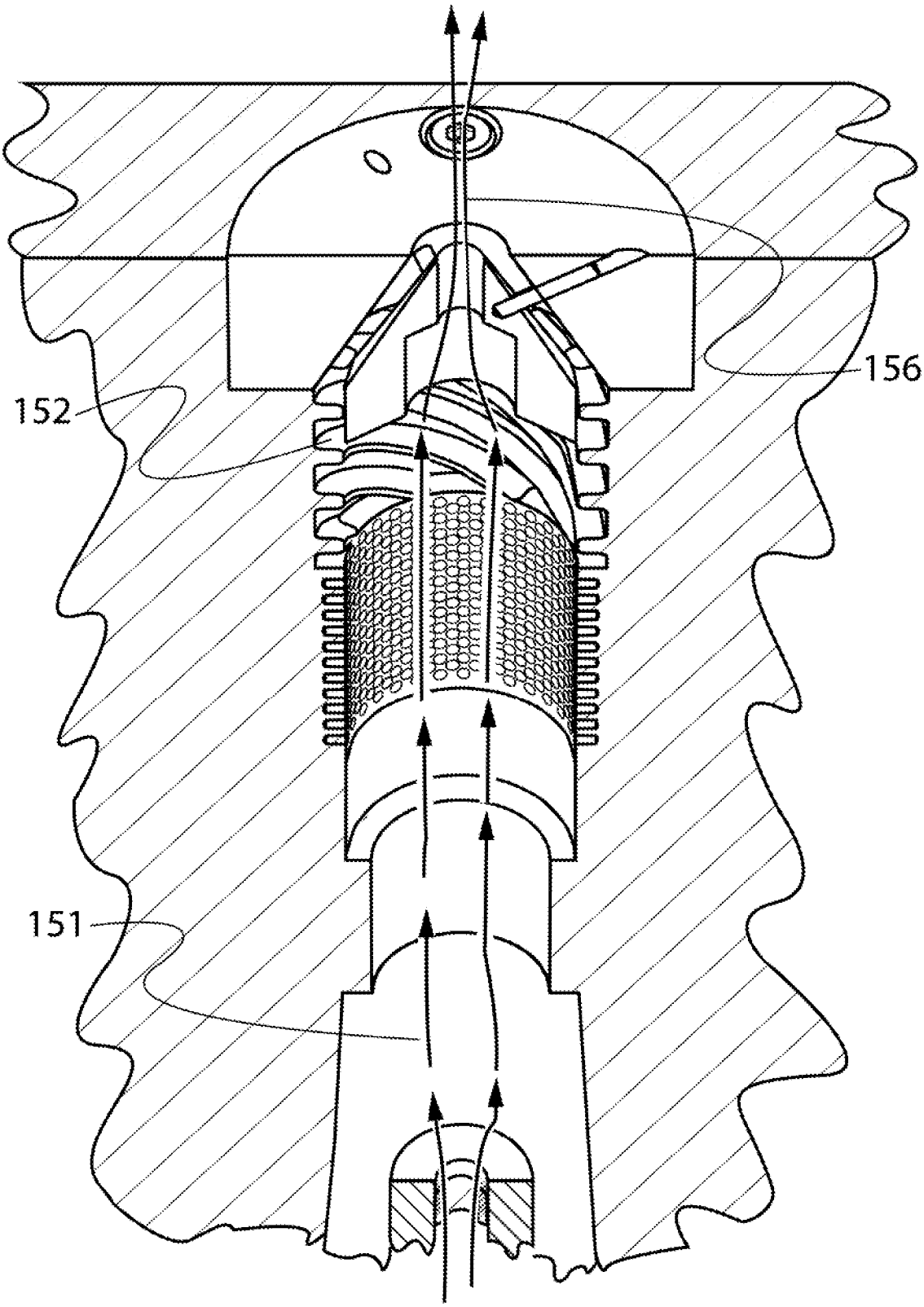
FIG. 26 is a partial cross-sectional and partial pictorial view of the embodiment shown in FIGS. 23-25 showing a predicted inner area flow path.

An expected flow pattern for the inner stream is illustrated in more detail in FIG. 26. The inner stream flow may progress from the injection nozzle and may slightly expand into the main flow. The inner stream flow may be constricted in the neckdown area 151, but may not compress as much as the previously discussed outer stream. The inner stream flow may decompress slightly and progress through the turbulence and spin area 152 with little change to the flow vector. The inner stream flow then may be separated by the layered passages of the nozzle. The inner stream flow enters the center of the nozzle and may be compressed to assist in focusing the stream and may be ejected from the end of the nozzle. The increased motion intensity of the outer stream spinning over the inner stream may allow the outer stream to slightly compress and focus the inner stream past the end of the nozzle as shown in the external neckdown area 156.

Figure 21:
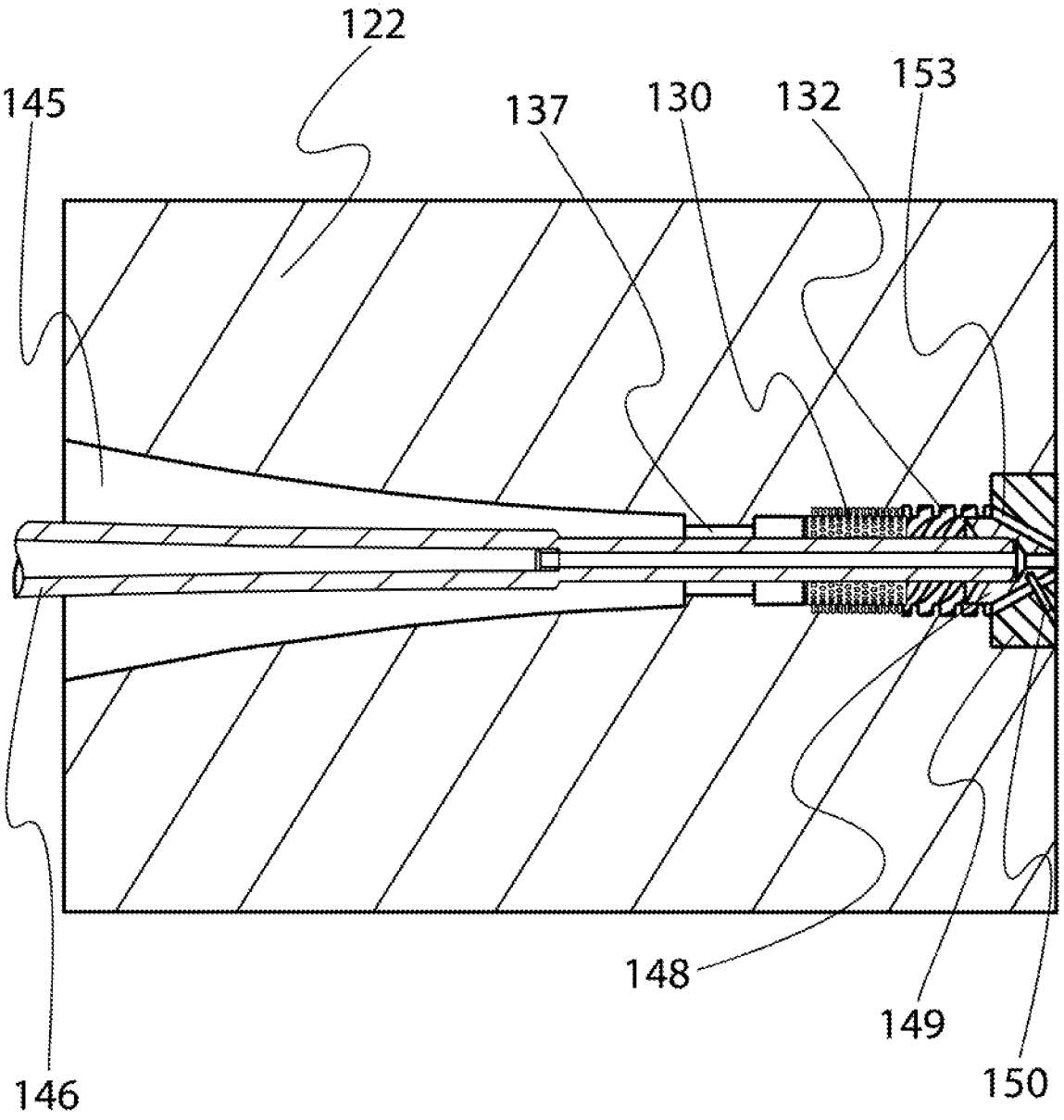
FIG. 21 is a side cross-sectional view of an eleventh stratified stream injection and turbulence system embodiment of the present invention.
Figure 22:
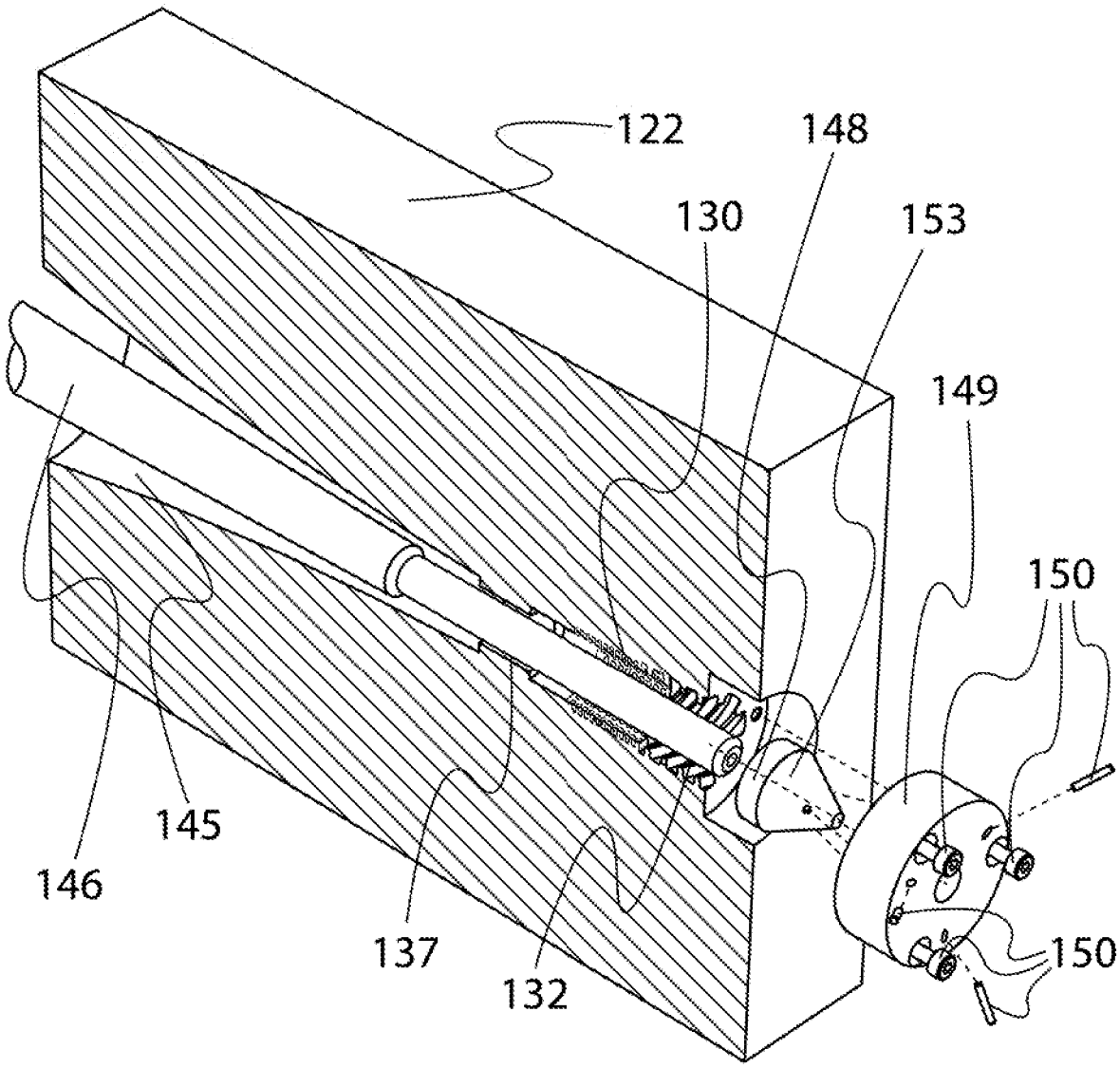
FIG. 22 is an exploded partial cross-sectional and partial pictorial view of the embodiment shown in FIG. 21.

In FIGS. 21 and 22 an alternate embodiment to that described in connection with FIGS. 19 and 20 is shown, with similar function except as noted below. In the FIGS. 21 and 22 embodiment, the injected material may be provided to the stream via a centrally located long injection nozzle 146. The long injection nozzle 146 may extend into the inner nozzle 148. This may allow the injected material to be injected at a lower pressure due to decreased back-pressure realized by the long injection nozzle 146. This decreased back pressure may be created by a low-pressure area formed by a small flow between the inner nozzle 148 and the tip of the long injection nozzle 146.

As in the previous implementation, the long injection nozzle 146 may provide a more uniform drag profile. Therefore, as shown in FIG. 21, localized turbulence may be further enhanced by adding a decreased diameter tumble area 137 along the diameter transition of the long injection nozzle 146. This may cause the flow to constrict and arc outward towards the walls. As shown in FIG. 21, this may urge the outer edges of the stream along an arc into the patterned pocket tumble area 130, which may induce a tumbling action. This action may be carried into the next section of the helical fins tumble area 132, which are cut counter-clockwise. The toroidal flow may continue into the pirouette area 153.

The pirouette area 153 is a truncated decreasing diameter conical area, which may force the toroidal flow to move at a defined angle towards the center of the flow stream. This may continually decrease the main body foci diameter of the outer flow stream, which may increase the angular flow speed along an additional angular vector. This vorticity may continue slightly past the tip of the nozzle, and make it focus the stream tighter for a longer distance past the physical nozzle tip. With reference to FIG. 18, the counter-clockwise threads may increase cooperative reinforcement between the poloidal flow 243 and a counter-clockwise toroidal flow 245. This may induce a counter-clockwise toroidal flow at an angle defined by the angle of the nozzle which creates a helically twisted conical-shaped vortex ring 242.

Figure 23:
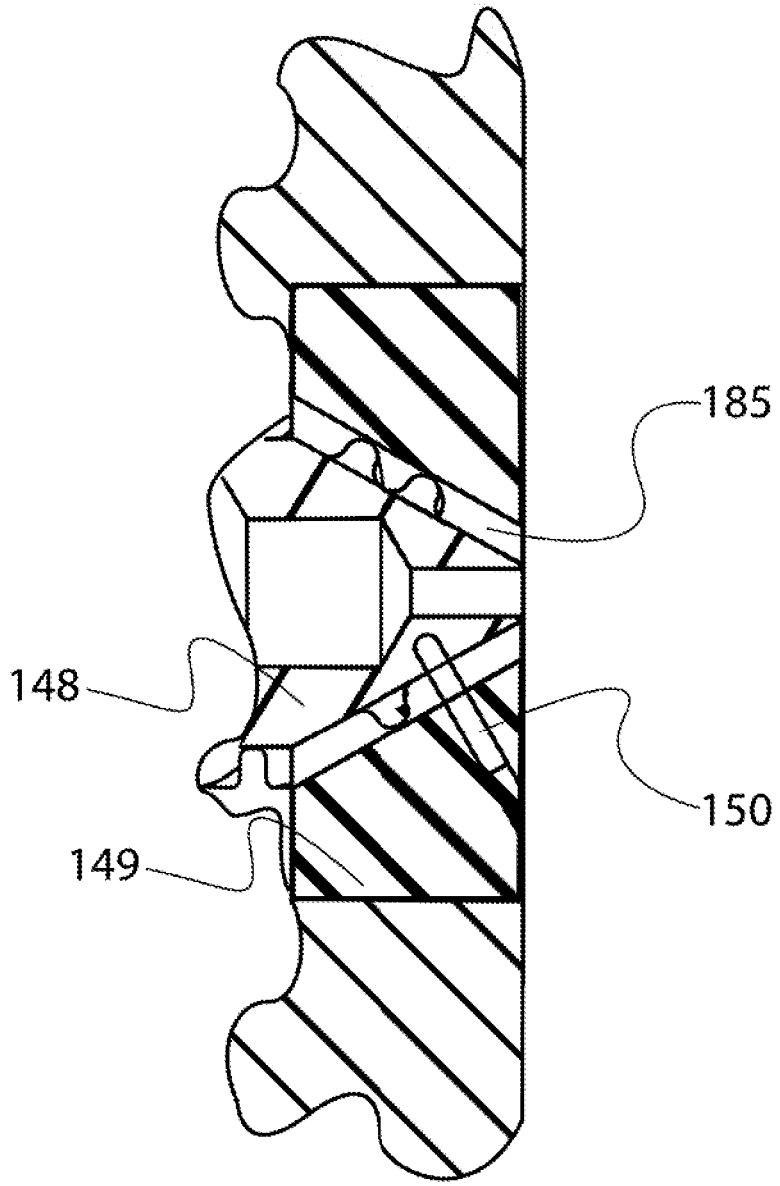
FIG. 23 is a side cross-sectional view of a twelfth stratified stream turbulence system embodiment of the invention.
Figure 24:
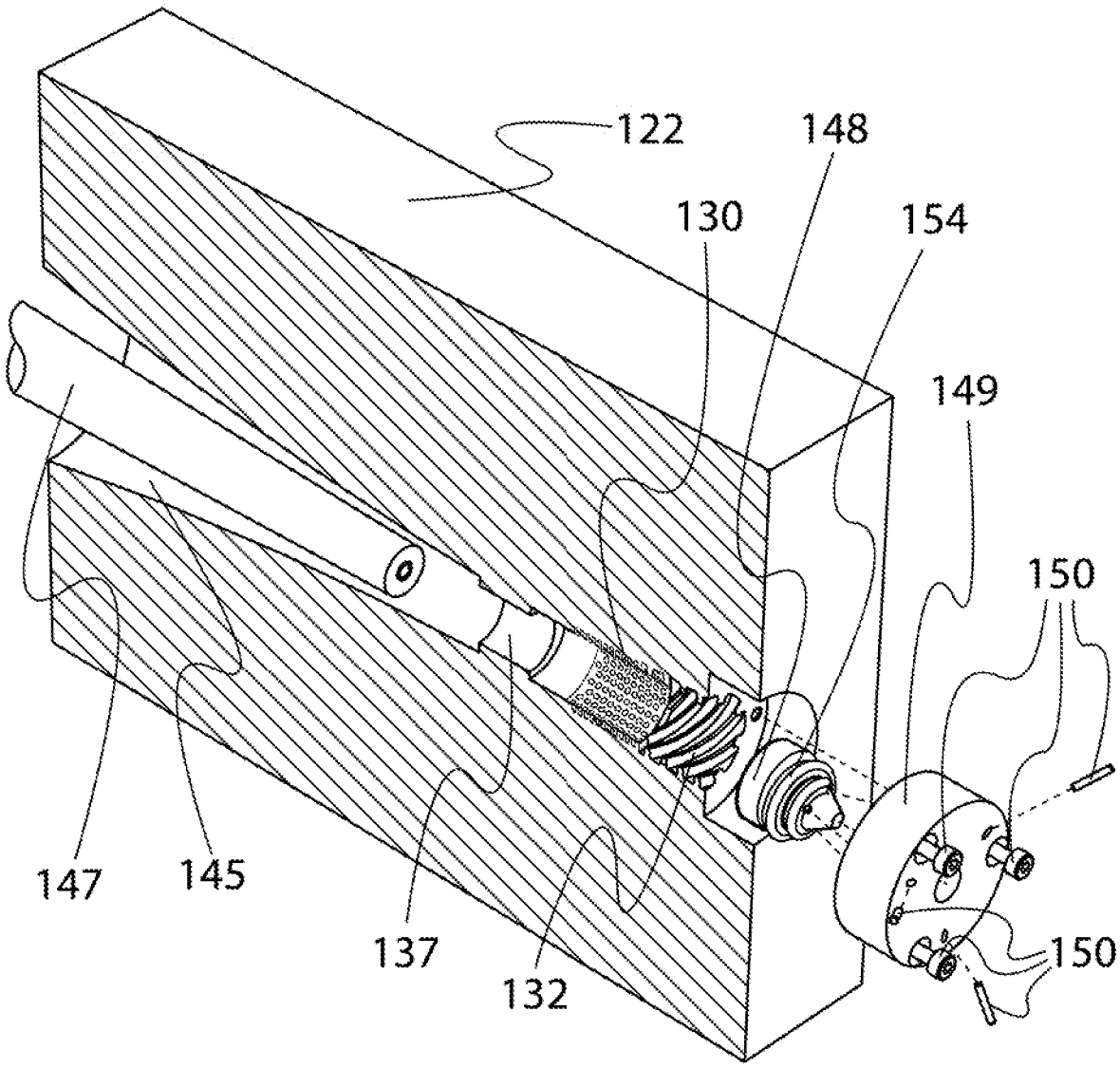
FIG. 24 is an exploded partial cross-sectional and partial pictorial view of the embodiment shown in FIG. 23.

In FIGS. 23 and 24, an another alternate embodiment to those described in connection with FIGS. 19-22 is shown, with similar function except as noted below. In the FIGS. 23 and 24 embodiment, the injected material may be provided to the stream via a centrally located short injection nozzle 147 (or alternatively, in other embodiments, a long nozzle of the type shown in FIG. 21). As in the previous embodiment, the short injection nozzle 147 may provide a uniform drag profile. Therefore, as shown in FIGS. 23 and 24, localized turbulence may be further enhanced by adding a decreased diameter tumble area 137 along the diameter transition of the long injection nozzle 147. This may cause the flow to constrict and then arc outward towards the walls. As shown in FIGS. 23 and 24, this may urge the outer edges of the stream along an arc into the patterned pocket tumble area 130, which may induce a tumbling action. The tumbling action may be carried into the next section of the helical fins tumble area 132, which are cut counter-clockwise. The toroidal flow may continue into the helical guided fin pirouette area 154. As shown in FIGS. 23 and 24, the helical guided fin pirouette area 154 is the space between the helically wound guiding fins 185 formed along the outside surface of the inner nozzle 148 and the inside surface of the outer nozzle 149.

The helical guided fin pirouette area 154 is a truncated decreasing diameter conical area with helically wound guiding fins 185 that forces the toroidal flow to move at a defined angle and helical pitch towards the center of the flow stream. This may continually decrease the main body foci diameter of the outer flow stream, which may increase the angular flow speed along the helical path. The helical guided fin pirouette area 154 may generate a high amount of coherent turbulence which actually compresses the central stream while forcing the central stream to spin, the coherent turbulence then forces the central stream to mix with the outer stream. This also may tend to force the ejected material from the nozzle to form a conical fan-spray shape.

While the described double-layer nozzle embodiments are illustrated with components joined by fasteners, it may be possible to weld/glue the components, cast, 3D rapid manufacture, or use other suitable means to create the multiple components presented here as one component. It is also possible that a nozzle implementation could have more than two layers if the implementation requires a different focusing pattern or has more than two streams making it a multi-layer nozzle. This double-layer nozzle may be used in numerous implementations such as furnaces, stoves, grills, ovens, fireplaces, turbines, jet engines, welding, water jetting, plasma/gas/electron cutting, 3D printing/additive manufacturing, and many other possible applications which may benefit from a nozzle with tight focus at an extended distance. The embodiments which use the helically wound guiding fins along the outside surface of the inner nozzle can swirl a larger cross-section of the outer stream area and/or make this swirl very strong. This swirl may also be tailored to the application by changing the nozzle back-pressure via nozzle orifice sizes and by modifying the generated turbulence via pattern geometry changes. This has possible applications in the painting and coating industries with paints that tend to coagulate or become unmixed during high pressure spraying. It has dispensing/spraying applications such as agricultural spraying, fire suppression systems, and fire-fighting gear. It may also have applications for furnaces, stoves, grills, ovens, fireplaces, chemical mixing nozzles, and/or in marine thrusters on jet-skis for example.

If the designed vorticity and flow vectors exert significantly high pressures, it may be possible to also use this nozzle design to carry-out chemical reactions and/or matter state changes using these methods. For example, embodiments of the present invention may be designed to compression ignite fuels at the tip of the nozzle due to the increased vorticity and pressure present at this area. Embodiments of the invention may also be used to compress vapors into liquids or solids due by creating the required vorticity and pressure at the nozzle tip, which could have applications in refrigeration and chemical processing. Embodiments of the invention may also be used to facilitate chemical reactions that require controlled high pressure and to facilitate the formation of more complex physical structures which typically require chemical scaffolds such as polymers, catalysts/enzymes, and proteins. Embodiments of the invention may also be used to induce desirable grain structures or other matter structures/states at lower process points with less energy than previously required, especially if catalysts and/or catalyzed surface coatings are employed.

The described double-layer nozzle embodiments may also be applied to more viscous materials with proper internal design and pumping accommodations. An injection ring within the outer stream turbulence generation areas may be used to inject gases or liquids into materials during processing/dispensing. The nozzle may be designed for easy disassembly, sanitizing/servicing, and reintroduction to service. These designs may be used in the industrial, commercial, and consumer culinary fields such as in coffee machines, whipped cream dispensing, mayonnaise/margarine emulsion creation, butter/milk processing, whipped cheese processing, dough/batter mixing/dispensing, ice cream/frozen yogurt packaging/dispensing, and milkshake machines.

Figure 14:
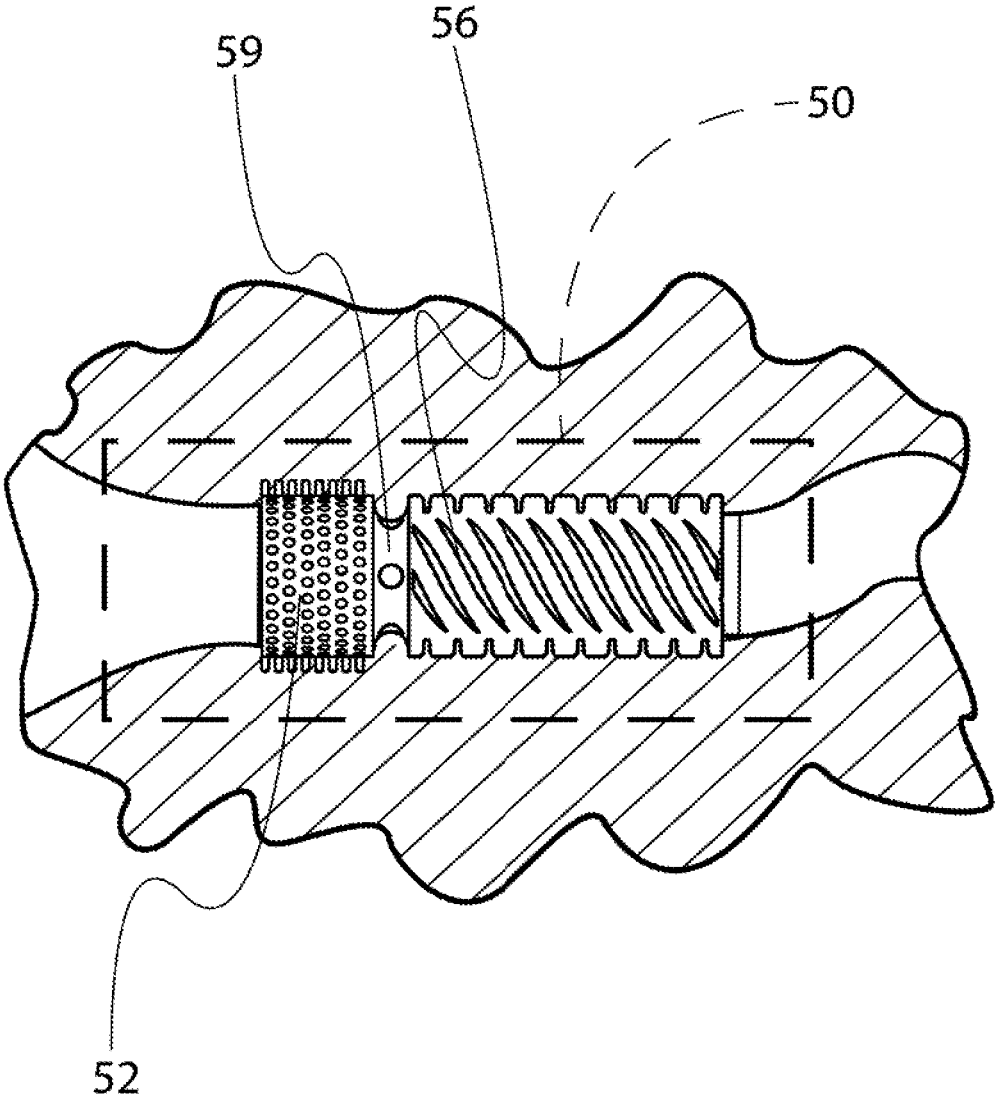
FIG. 14 is a side cross-sectional view of a tumble area constructed in accordance with a ninth internal combustion engine injection and ignition system embodiment of the present invention.

An alternative embodiment similar to that of FIG. 11 is illustrated in FIG. 14. The FIG. 14 embodiment differs in that it adds a water/water-blend injection method into the outer stratified stream. With reference to FIGS. 11 and 14, the length of the patterned pocket tumble area 52 in the tumble area 50 was slightly decreased to accommodate an injection ring 59 between the patterned pocket tumble area 52 and the pattern 56 of fins/grooves. This injection ring 59 may provide a multi-point egress into the outer stratified stream as it is tumbling, but before it has coherently formed into a helical toroidal ring. Injection at this point may allow a water or a water-blend, such as water-methanol, to be injected at low pressure as the tumbling air tends to draw the water or water-blend into the outer stream by creating low pressure areas over the injection points. The vorticity and stream lines produced by this embodiment may be virtually unaffected by the addition of the injection ring 59.

The flow paths for the material leaving the injection ring may be influenced by the turbulent motion in the outer stream. This may cause the overall flow paths to spin helically, while being contained in the overall outer stream which is also tumbling around the flow paths. Some of the flow may pass behind and in front of the sparkplug, allowing the injected material to be near the origin of the flame kernel, but not directly in it to avoid quenching. Other flow paths may fan out through the expansion area and assist with the anti-backflow action of this feature when the water/water-blend expands during combustion.

This injection strategy may allow water vapor and/or other desirable chemicals to be encased within the outer toroidal ring to enhance the previously discussed thermal buffering effects. The injected material may create a greater thermal time delay by adding thermal mass to the outer stream, which requires more energy to heat. This injected material may also increase the working pressures imposed upon the inner stream as the materials expand or flash to gas. This material may also provide some surface cooling effects to the skin layer of the piston and the chamber walls during entry and expansion into the combustion chamber to reduce hot-spots without washing away desirable oil films. This injected material may further lower peak combustion temperatures and smooth the combustion reaction rate curve over the allowable time period. If a water-methanol blend is used, it may increase the apparent overall octane level of the charge near the end of the combustion cycle and may allow more aggressive timing or compression ratios for more power in less space without the onset of knock or detonation.

While the previously discussed implementations utilize fuel injection and direct egress into the combustion chamber, the turbulent stream may be applied to carburetors, throttle body injection units, port injection/wet foggers, and/or intake manifolds. The ignition source would need to remain in the combustion chambers and the aforementioned component(s) would need to have structures and passage geometries to induce the stratified stream(s). A stratified stream implementation would prohibit fuel pooling and wetting within the intake manifold and increase vaporization rates through the intimate contact of the air and fuel within the center area of the stream.

The stratified stream may provide the previously discussed buffering effect to isolate the fuel from the intake manifold walls, just as it does in a direct combustion chamber egress application. This may allow the selected fueling strategy to fuel the engine more effectively with less waste. If the coherent motion is maintained during the intake cycle of the combustion chamber, the system may also provide the previously discussed improvements to combustion, such as slightly leaner burns, lower peak combustion temperatures, increased pressure, improved chamber loading, lower thermal losses to the cooling system, skin effect surface cooling within the combustion chamber, increased combustion rate, more complete combustion, reduced knock/detonation tendencies, reduced quenching, improved functioning at higher RPMs with a properly designed valve train, and reduced undesirable emissions. These benefits could improve fuel efficiency for restricted racing league vehicles, generators, power sports vehicles, lawn equipment, construction equipment, and other engines still utilizing carburetors or more traditional injection techniques. While these stratified stream applications may provide some quantifiable improvement, the difference may not be as significant as the direct combustion chamber egress applications previously discussed.

As will be understood by those skilled in the art, the invention may be embodied in other specific forms without departing from the spirit or essential characteristics thereof. The elements described above are illustrative examples of one technique for implementing the invention. One skilled in the art will recognize that many other implementations are possible without departing from the intended scope of the present invention as recited in the claims. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. A stratified stream system comprised of:

a passage extending from an input port to an exit port, said passage configured to receive a supply of working fluid at the input port;

a funnel portion in said passage, said funnel portion having a greater flux area at a point proximal to the input port than at a point distal from the input port; and a tumble area provided in said passage between the funnel portion and the exit port, wherein the funnel portion and tumble area are configured to induce the working fluid to form a stratified stream having an outer portion of the working fluid having a toroidal flow characteristic and an inner portion of the working fluid surrounded by the outer portion of the working fluid.

2. The stratified stream system of claim 1, wherein the funnel portion and tumble area are further configured to induce the working fluid to have a poloidal flow characteristic.

3. The stratified stream system of claim 2, wherein the funnel portion and tumble area are further configured to induce the working fluid to have a helical flow characteristic.

4. The stratified stream system of claim 1, wherein the funnel portion and tumble area are further configured to induce the working fluid to have a helical flow characteristic.

5. The stratified stream system of claim 1, further comprising:

an injector nozzle extending into said passage between the input port and an end of the tumble area proximal to the exit port.

6. The stratified stream system of claim 5, wherein the injector nozzle is a fuel injector nozzle in an internal combustion engine.

7. The stratified stream system of claim 6, further comprising a sparkplug ramp disposed in said passage between the tumble area and the exit port.

8. The stratified stream system of claim 5, further comprising an integrated injector ramp disposed in said funnel portion.

9. The stratified stream system of claim 1, wherein the tumble area includes a pattern of pockets.

10. The stratified stream system of claim 9, wherein the tumble area further includes a fuel ramp.

11. The stratified stream system of claim 9, wherein the tumble area further includes a pattern of fins/grooves.

12. The stratified stream system of claim 11, further comprising an injection ring disposed between the pattern of pockets and the pattern of fins/grooves.

13. The stratified stream system of claim 1, wherein the tumble area includes a pattern of fins.

14. The stratified stream system of claim 13, wherein the tumble area further includes a decreased diameter portion defined by a shoulder formed between the funnel portion and the pattern of fins.

15. The stratified stream system of claim 1, wherein the tumble area includes a pattern of grooves.

16. The stratified stream system of claim 15, wherein the tumble area further includes a decreased diameter portion defined by a shoulder formed between the funnel portion and the pattern of grooves.

17. The stratified stream system of claim 1, wherein the tumble area includes a decreased diameter portion defined by a shoulder formed between the funnel portion and the tumble area.

18. The stratified stream system of claim 17, wherein the tumble area further includes a patterned pocket portion.

19. The stratified stream system of claim 18, wherein the tumble area further includes a helical fins portion.

20. The stratified stream system of claim 19, wherein the tumble area further includes a pirouette area.

21. The stratified stream system of claim 1, wherein the tumble area includes a pirouette area.

22. The stratified stream system of claim 1, wherein the tumble area includes a wire mesh tube or a perforated thin-wall tube.

23. The stratified stream system of claim 1, wherein the tumble area includes a fuel ramp.

24. A stratified stream system comprised of:

a passage extending from an input port to an exit port;

a funnel portion in said passage; and a tumble area having a non-smooth surface, said tumble area provided in said passage between the funnel portion and the exit port, wherein the funnel portion and tumble area are configured to induce the working fluid to form a stratified stream having an outer portion of the working fluid having a toroidal flow characteristic and an inner portion of the working fluid surrounded by the outer portion of the working fluid.

25. The stratified stream system of claim 24, wherein the toroidal flow characteristic is maintained in the outer portion of the working fluid to a point beyond the exit port.

26. A method of providing a stream of material using a working fluid comprising the steps of:

passing the working fluid through a funnel and a tumble area to induce the working fluid to form a stratified stream having an outer portion of the working fluid with a toroidal flow characteristic and an inner portion of the working fluid surrounded by the outer portion of working fluid; and injecting the material into the inner portion of the working fluid.

27. The stratified stream system of claim 1, wherein the toroidal flow characteristic is maintained in the outer portion of the working fluid to a point beyond the exit port.

* * * * *